US010436508B2

(12) United States Patent
Tachibana

(10) Patent No.: US 10,436,508 B2
(45) Date of Patent: Oct. 8, 2019

(54) AIR SEPARATION METHOD AND AIR SEPARATION APPARATUS

(71) Applicant: TAIYO NIPPON SANSO CORPORATION, Tokyo (JP)

(72) Inventor: Hiroshi Tachibana, Tokyo (JP)

(73) Assignee: TAIYO NIPPON SANSO CORPORATION, Tokyo (JP)

( * ) Notice: Subject to any disclaimer, the term of this patent is extended or adjusted under 35 U.S.C. 154(b) by 1035 days.

(21) Appl. No.: 14/768,531

(22) PCT Filed: Feb. 3, 2014

(86) PCT No.: PCT/JP2014/052416
§ 371 (c)(1),
(2) Date: Aug. 18, 2015

(87) PCT Pub. No.: WO2014/132751
PCT Pub. Date: Sep. 4, 2014

(65) Prior Publication Data

US 2016/0003537 A1 Jan. 7, 2016

(30) Foreign Application Priority Data

Feb. 26, 2013 (JP) ..... 2013-036185

(51) Int. Cl.
*F25J 3/04* (2006.01)

(52) U.S. Cl.
CPC ..... *F25J 3/04448* (2013.01); *F25J 3/0429* (2013.01); *F25J 3/04296* (2013.01);
(Continued)

(58) Field of Classification Search
CPC ..... F25J 3/04448; F25J 3/04454; F25J 3/04; F25J 3/04654; F25J 3/04296; F25J 3/04709
See application file for complete search history.

(56) References Cited

U.S. PATENT DOCUMENTS 4,533,375 A * 8/1985 Erickson ..... F25J 3/04072 62/651
4,737,177 A 4/1988 Erickson
(Continued)

FOREIGN PATENT DOCUMENTS

DE 100 61 908 6/2002
EP 0 694 745 1/1996
(Continued)

OTHER PUBLICATIONS

International Search Report for PCT/JP2014/052416 dated Apr. 22, 2014, two pages.
(Continued)

*Primary Examiner* — John F Pettitt, III
(74) *Attorney, Agent, or Firm* — Nixon & Vanderhye P.C.

(57) ABSTRACT

One object of the present invention is to provide an air separation method and an air separation apparatus which can collect a larger amount of nitrogen gas, liquefied oxygen, and liquefied nitrogen which have higher pressure than the operating pressure in the low-pressure column while inhibiting a decrease of the argon recovery, and the present invention provides an air separation method comprising a step in which the low-pressure liquefied oxygen at the bottom part of the low-pressure column is reboiled by the argon gas at the top part of the argon column and the middle-pressure nitrogen gas at the top part of the middle-pressure column, and a step in which the middle-pressure liquefied oxygen at the bottom part of the argon column is reboiled by the high-pressure nitrogen gas at the top part of the high-pressure column.

2 Claims, 6 Drawing Sheets

(52) U.S. Cl.
CPC ..... *F25J 3/04303* (2013.01); *F25J 3/04654* (2013.01); *F25J 3/04715* (2013.01); *F25J 3/04872* (2013.01); *F25J 3/04884* (2013.01); *F25J 2200/10* (2013.01); *F25J 2210/40* (2013.01); *F25J 2235/02* (2013.01); *F25J 2235/50* (2013.01); *F25J 2250/20* (2013.01)

(56) References Cited

U.S. PATENT DOCUMENTS

| | | | |
|---|---|---|---|
| 4,822,395 | A | 4/1989 | Cheung |
| 6,196,024 | B1 | 3/2001 | Ha |
| 2007/0095100 | A1 | 5/2007 | Rankin et al. |
| 2014/0109614 | A1 | 4/2014 | Tachibana et al. |

FOREIGN PATENT DOCUMENTS

| | | |
|---|---|---|
| EP | 1 055 893 | 11/2000 |
| JP | 2000-356465 | 12/2000 |
| JP | 2000-356495 | 12/2000 |
| JP | 2001-194508 | 7/2001 |
| JP | 4540182 | 9/2010 |
| JP | 4787796 | 7/2011 |
| JP | 4939651 | 5/2012 |
| JP | 2013-11374 | 1/2013 |
| WO | WO 2013/002025 | 1/2013 |

OTHER PUBLICATIONS

Extended European Search Resort issued in App. No. 14756460.3 dated Oct. 4, 2016.
Chinese Office Action issued in Application No. 201480004053.9 dated Apr. 13, 2016 (w/ partial translation).

* cited by examiner

AIR SEPARATION METHOD AND AIR SEPARATION APPARATUS

TECHNICAL FIELD

The present invention relates to an air separation method and an air separation apparatus.

This application is the U.S. national phase of International Application No. PCT/JP2014/052416 filed Feb. 3, 2014 which designated the U.S. and claims priority to Japanese Patent Application No. 2013-036185, filed Feb. 26, 2013, the entire contents of each of which are incorporated herein by reference.

BACKGROUND ART

FIG. 6 is a schematic block diagram showing a conventional air separation apparatus.

In the past, when oxygen, argon, etc. were produced by low-temperature processing cryogenic separation of air, an air separation apparatus 200 shown in FIG. 6 was used.

As shown in FIG. 6, the air separation apparatus 200 includes an air compressor 201, an air precooler 202, an air purifier 204, a turbine blower 205, a turbine blower aftercooler 206, a turbine 208, a main heat exchanger 211, a low-pressure column 213, a low-pressure column reboiler 214 at the bottom part of the low-pressure column 213, an middle-pressure column 216, a subcooler 218, an argon column 221, and an argon column condenser 222 at the top part of the argon column 221.

When oxygen, nitrogen, argon, etc. were produced using the air separation apparatus 200, oxygen enriched liquefied air, which was withdrawn from the bottom part of the middle-pressure column 216, was vaporized in the argon column condenser 222, and then introduced into the low-pressure column 213 as oxygen enriched air. In the air separation apparatus 200, low-pressure liquefied oxygen at the bottom part of the low-pressure column 213 was reboiled using middle-pressure nitrogen gas at the top part of the middle-pressure column 216.

In addition, when oxygen, nitrogen, argon, etc. were produced using the air separation apparatus 200, it is also possible to withdraw liquefied oxygen ($LPLO_2$) from the bottom part of the low-pressure column 213, or middle-pressure nitrogen gas ($MPGN_2$) and liquefied nitrogen ($MPLN_2$) from the top part of the middle-pressure column 216, in addition to argon gas and liquefied argon (LAR). However, when the flow rate of the liquefied oxygen ($LPLO_2$), the middle-pressure nitrogen gas ($MPGN_2$) or the liquefied nitrogen ($MPLN_2$) increases, the argon recovery decreases.

Moreover, "yield" means the ratio of flow rate of each product relative to the flow rate of feed air supplied in the air separation apparatus 200.

Patent Document 1 discloses an air separation method and an air separation plant which can increase the amount of gaseous oxygen obtained by separation of air by low-temperature distillation using a double column.

Patent Document 1 discloses a method for improving the yield of oxygen by adding a mixing column in addition to a low-pressure column, a middle-pressure column, and an argon column, and overhead gas from the top part of the mixing column is supplied to the bottom reboiler of the low-pressure column.

In addition, Patent Document 1 also discloses that the argon recovery can be maintained or improved even when a flow rate which corresponds to 10 to 15% of feed air is collected as middle-pressure nitrogen gas from the middle-pressure column or a flow rate which corresponds to 10 to 15% of feed air is sent to the low-pressure column as blowing air.

Furthermore, Patent Document 1 discloses that a part of middle-pressure nitrogen gas or a part of the feed air is expanded by a turbine into low-pressure nitrogen or blowing air, coldness is generated, and a liquefied gas product is collected. In other words, even when a certain amount of the liquefied gas product is collected, the argon recovery can be maintained or improved.

Patent Document 2 discloses a technique which can improve the argon recovery. Specifically, Patent Document 2 discloses that oxygen enriched liquefied air withdrawn from the bottom part of a high-pressure column is supplied to a gas-liquid contact part and distilled at low temperatures, gasses having a different oxygen concentration which are separated at the gas-liquid contact part are supplied into a low-pressure column, rectification conditions of the low-pressure column are improved, and thereby the argon recovery is improved.

PRIOR ART DOCUMENT

Patent Document

[Patent Document 1] Japanese Unexamined Patent Application, First Publication No. 2001-194058

[Patent Document 2] U.S. Pat. No. 4,737,177

SUMMARY OF THE INVENTION

Problems to be Solved

At the present time, for example, the air separation apparatus 200 shown in FIG. 6 is used to separate air. However, when the air separation apparatus 200 is used, and a large amount of nitrogen gas (middle-pressure nitrogen gas), liquefied oxygen, and/or liquefied nitrogen, which has higher pressure than that the pressure in the low-pressure column 213, was collected, there is a problem in that the argon recovery decreases.

On the other hand, the technique disclosed in Patent Document Nos. 1 and 2 can improve the argon recovery. However, in reality, the argon recovery is improved by a few percentages, and it is impossible to sufficiently improve the argon recovery.

Therefore, an object of the present invention is to provide an air separation method and an air separation apparatus which can collect a larger amount of middle-pressure nitrogen gas, high-pressure nitrogen gas having higher pressure than that of the middle-pressure nitrogen gas, liquefied oxygen, liquefied nitrogen, and so on while inhibiting a decrease of the argon recovery.

Means to Solve the Problems

In order to achieve the object, the present invention provides the following air separation methods.

An air separation method including:

a low-pressure oxygen separation step in which a mixed fluid containing oxygen, nitrogen, and argon, which is a low-pressure feed supplied into a low-pressure column, is distilled at low temperatures, and the mixed fluid is separated into low-pressure nitrogen gas, low-pressure liquefied oxygen, and liquefied feed argon;

an argon separation step in which the liquefied feed argon is distilled at low temperatures, and separated into argon gas and middle-pressure liquefied oxygen:

a first indirect heat exchange step in which, by indirect heat exchange between the argon gas and the low-pressure liquefied oxygen, the argon gas is liquefied, and liquefied argon is produced while a part of the low-pressure liquefied oxygen is vaporized, and low-pressure oxygen gas is produced;

a second indirect heat exchange step in which, by indirect heat exchange between middle-pressure nitrogen gas supplied from a middle-pressure column and the low-pressure liquefied oxygen, the middle-pressure nitrogen gas is liquefied and middle-pressure liquefied nitrogen is produced while a part of the low-pressure liquefied oxygen is vaporized, and low-pressure oxygen gas is produced;

a third indirect heat exchange step in which, by indirect heat exchange between high-pressure nitrogen gas supplied from a high-pressure column and the middle-pressure liquefied oxygen, the high-pressure nitrogen gas is liquefied and high-pressure liquefied nitrogen is produced while a part of the middle-pressure liquefied oxygen is vaporized, and middle-pressure oxygen gas is produced;

a first product withdrawing step in which at least one kind of argon among a part of the argon gas, a part of argon gas which is not liquefied in the first indirect heat exchange step, and the liquefied argon is withdrawn as a product; and a second product withdrawing step in which at least one among the low-pressure liquefied oxygen which is not vaporized in the first and second indirect heat exchange steps, the middle-pressure liquefied oxygen which is not vaporized in the third indirect heat exchange step, a part of the middle-pressure nitrogen gas at the top part of the middle-pressure column, a part of the middle-pressure liquefied nitrogen at the top part of the middle-pressure column, a part of the high-pressure nitrogen gas at the top part of the high-pressure column, and a part of the high-pressure liquefied nitrogen at the top part of the high-pressure column, is withdrawn as a product.

It is preferable that the air separation method further include:

a high-pressure nitrogen separation step in which a part or the whole of high-pressure feed air, which is obtained by compressing, purifying, and cooling air containing oxygen, nitrogen, and argon, is distilled at low temperatures, and separated into high-pressure nitrogen gas and high-pressure oxygen enriched liquefied air;

a middle-pressure nitrogen separation step in which a part or the whole of middle-pressure feed air which is obtained by compressing, purifying, and cooling air containing oxygen, nitrogen, and argon, is distilled at low temperatures, and separated into middle-pressure nitrogen gas and middle-pressure oxygen enriched liquefied air; and a low-pressure feed supply step in which the high-pressure oxygen enriched liquefied air and the middle-pressure oxygen enriched liquefied air are decompressed, and at least one of decompressed high-pressure oxygen enriched liquefied air and decompressed middle-pressure oxygen enriched liquefied air is supplied into the low-pressure column as the low-pressure feed.

It is also preferable that the air separation method further include:

a high-pressure nitrogen separation step in which a part or the whole of high-pressure feed air, which is obtained by compressing, purifying, and cooling air containing oxygen, nitrogen, and argon, is distilled at low temperatures, and separated into high-pressure nitrogen gas, and high-pressure oxygen enriched liquefied air;

a middle-pressure nitrogen separation step in which the high-pressure oxygen enriched liquefied air is decompressed, and a part or the whole of the decompressed high-pressure oxygen enriched liquefied air is distilled at low temperatures, and separated into middle-pressure nitrogen gas and middle-pressure oxygen enriched liquefied air;

a fourth indirect heat exchange step in which, by the indirect heat exchange between a part of the high-pressure nitrogen gas and the middle-pressure oxygen enriched liquefied air, a part of high-pressure nitrogen gas is liquefied, and high-pressure liquefied nitrogen is produced while a part of the middle-pressure oxygen enriched liquefied air is vaporized, and middle-pressure oxygen enriched air is produced; and a low-pressure feed supply step in which the middle-pressure oxygen enriched liquefied air which is not vaporized in the fourth indirect heat exchange step is decompressed, and supplied into the low-pressure column as a low-pressure feed.

In addition, it is also preferable that the air separation method include, instead of the fourth indirect heat exchange step, a fifth indirect heat exchange step in which, by the indirect heat exchange between a part of the high-pressure feed air or a part of high-pressure nitrogen enriched air which rises in the high-pressure column and the middle-pressure oxygen enriched liquefied air, a part of the high-pressure feed air or a part of the high-pressure nitrogen enriched air is liquefied, and high-pressure liquefied air or high-pressure nitrogen enriched liquefied air is produced while a part of the middle-pressure oxygen enriched liquefied air is vaporized, and middle-pressure oxygen enriched air is produced.

In addition, it is also preferable that the air separation method include:

a high-pressure nitrogen separation step in which a part or the whole of high-pressure feed air, which is obtained by compressing, purifying, and cooling air containing oxygen, nitrogen, and argon, is distilled at low temperatures, and separated into high-pressure nitrogen gas, and high-pressure oxygen enriched liquefied air;

a middle-pressure nitrogen separation step in which a part or the whole of the high-pressure oxygen enriched liquefied air is decompressed, distilled at low temperatures, and separated into middle-pressure nitrogen gas and middle-pressure oxygen enriched liquefied air;

a fourth indirect heat exchange step in which, by the indirect heat exchange between a part of the high-pressure nitrogen gas and the middle-pressure oxygen enriched liquefied air, a part of the high-pressure nitrogen gas is liquefied, and high-pressure liquefied nitrogen is produced while a part of the middle-pressure oxygen enriched liquefied air is vaporized, and middle-pressure oxygen enriched air is produced; and a sixth indirect heat exchange step in which, by the indirect heat exchange between a part of the high-pressure feed air or a part of high-pressure nitrogen enriched air which rises in the high-pressure column and the middle-pressure oxygen enriched liquefied air which is not vaporized in the fourth indirect heat exchange step, a part of the high-pressure feed air or a part of the high-pressure nitrogen enriched air is liquefied, and high-pressure liquefied air or high-pressure nitrogen enriched liquefied air is produced while a part of the middle-pressure oxygen enriched liquefied air is vaporized, and middle-pressure oxygen enriched air is produced; and a low-pressure feed supply step in which the middle-pressure oxygen enriched liquefied air which is not vaporized in the sixth indirect heat exchange step is decompressed, and supplied into the low-pressure column as the low-pressure feed.

In addition, in order to achieve the object, the present invention provides the following air separation apparatus.

An air separation apparatus including:

a low-pressure column in which a mixed fluid containing oxygen, nitrogen, and argon, which is a low-pressure feed, is distilled at low temperatures, and separated into low-pressure nitrogen gas, low-pressure liquefied oxygen, and liquefied feed argon;

an argon column in which the liquefied feed argon is distilled at low temperatures, and separated into argon gas and middle-pressure liquefied oxygen;

a first low-pressure column reboiler in which, by indirect heat exchange between the argon gas and the low-pressure liquefied oxygen, the argon gas is liquefied and liquefied argon is produced while a part of the low-pressure liquefied oxygen is vaporized, and low-pressure oxygen gas is produced;

a second low-pressure column reboiler in which, by indirect heat exchange between middle-pressure nitrogen gas supplied from a middle-pressure column and the low-pressure liquefied oxygen, the middle-pressure nitrogen gas is liquefied, and middle-pressure liquefied nitrogen is produced while a part of the low-pressure liquefied oxygen is vaporized, and low-pressure oxygen gas is produced;

an argon column reboiler in which, by indirect heat exchange between high-pressure nitrogen gas supplied from a high-pressure column and the middle-pressure liquefied oxygen, the high-pressure nitrogen gas is liquefied, and high-pressure liquefied nitrogen is produced while a part of the middle-pressure liquefied oxygen is vaporized, and middle-pressure oxygen gas is produced;

a first product withdrawing line in which at least one among a part of the argon gas, the argon gas which is not liquefied in the first low-pressure column reboiler, and a part of the liquefied argon is withdrawn as a product; and a second product withdrawing line in which at least one among the low-pressure liquefied oxygen which is not vaporized in the first and second low-pressure column reboilers, the middle-pressure liquefied oxygen which is not vaporized in the argon column reboiler, a part of the middle-pressure nitrogen gas at the top part of the middle-pressure column, a part of the middle-pressure liquefied nitrogen at the top part of the middle-pressure column, a part of the high-pressure nitrogen gas at the top part of the high-pressure column, and a part of the high-pressure liquefied nitrogen at the top part of the high-pressure column is withdrawn as a product.

It is preferable that the air separation apparatus further include:

a high-pressure column in which a part or the whole of high-pressure feed air, which is obtained by compressing, refining, and cooling air, is distilled at low temperatures, and separated into high-pressure nitrogen gas and high-pressure oxygen enriched liquefied air;

a middle-pressure column in which a part or the whole of middle-pressure feed air which is obtained by compressing, refining, and cooling air, is distilled at low temperatures, and separated into the middle-pressure nitrogen gas and middle-pressure oxygen enriched liquefied air; and a low-pressure feed supply line in which at least one of the decompressed high-pressure oxygen enriched liquefied air and the decompressed middle-pressure oxygen enriched liquefied air is supplied to the low-pressure column as the low-pressure feed.

In addition, it is preferable that the air separation apparatus further include:

a high-pressure column in which a part or the whole of high-pressure feed air which is obtained by compressing, refining, and cooling air, is distilled at low temperatures, and separated into high-pressure nitrogen gas and high-pressure oxygen enriched liquefied air;

a middle-pressure column in which a part or the whole of the high-pressure oxygen enriched liquefied air is distilled at low temperatures, and separated into the middle-pressure nitrogen gas and middle-pressure oxygen enriched liquefied air;

a first middle-pressure column reboiler in which, by indirect heat exchange between a part of the high-pressure nitrogen gas and the middle-pressure oxygen enriched liquefied air, a part of the high-pressure nitrogen gas is liquefied and high-pressure liquefied nitrogen is produced while a part of the middle-pressure oxygen enriched liquefied air is vaporized, and middle-pressure oxygen enriched air is produced; and a low-pressure feed supply line in which the middle-pressure oxygen enriched liquefied air which is not vaporized in the first middle-pressure column reboiler is decompressed, and the decompressed middle-pressure oxygen enriched liquefied air is supplied to the low-pressure column as the low-pressure feed.

In addition, it is preferable that the air separation apparatus include, instead of the first middle-pressure column reboiler, a second middle-pressure column reboiler in which, by indirect heat exchange between a part of the high-pressure feed air or a part of high-pressure nitrogen enriched air which rises in the high-pressure column and the middle-pressure oxygen enriched liquefied air, a part of the high-pressure feed air or a part of the high-pressure nitrogen enriched air is liquefied and high-pressure liquefied air or high-pressure nitrogen enriched liquefied air is produced while a part of the middle-pressure oxygen enriched liquefied air is vaporized, and middle-pressure oxygen enriched air is produced.

In addition, it is also preferable that the air separation apparatus further include:

a high-pressure column in which a part or the whole of high-pressure feed air, which is obtained by compressing, refining, and cooling air containing oxygen, nitrogen, and argon, is distilled at low temperatures, and separated into high-pressure nitrogen gas and high-pressure oxygen enriched liquefied air;

a middle-pressure column in which a part or the whole of the high-pressure oxygen enriched liquefied air is decompressed, distilled at low temperatures, and separated into the middle-pressure nitrogen gas and the middle-pressure oxygen enriched liquefied air;

a first middle-pressure column reboiler in which, by indirect heat exchange between a part of the high-pressure nitrogen gas and the middle-pressure oxygen enriched liquefied air, a part of the high-pressure nitrogen gas is liquefied and high-pressure liquefied nitrogen is produced while a part of the middle-pressure oxygen enriched liquefied air is vaporized, and middle-pressure oxygen enriched air is produced;

a third middle-pressure column reboiler in which, by indirect heat exchange between a part of the high-pressure feed air or a part of the high-pressure nitrogen enriched air which rises in the high-pressure column and the middle-pressure oxygen enriched liquefied air which is not vaporized in the first middle-pressure column reboiler, a part of the high-pressure feed air or a part of the high-pressure nitrogen enriched air is liquefied and high-pressure liquefied air or high-pressure nitrogen enriched liquefied air is produced while a part of the middle-pressure oxygen enriched liquefied air is vaporized, and middle-pressure oxygen enriched air is produced; and a low-pressure feed supply line in which the middle-pressure oxygen enriched liquefied air which is not vaporized in the third middle-pressure column reboiler is decompressed, and the decompressed middle-pressure oxygen enriched liquefied air is supplied to the low-pressure column as the low-pressure feed.

Effects of the Invention

According to the air separation method and the air separation apparatus of the present invention, it is possible to collect a larger amount of nitrogen gas, liquefied oxygen, and liquefied nitrogen which have higher pressure than the operating pressure in the low-pressure column while inhibiting a decrease of the argon recovery.

BEST MODE FOR CARRYING OUT THE INVENTION

Below, the embodiments of the present invention will be explained in detail with reference to figures. Moreover, the figures are used to explain constitutions of the embodiments according to the present invention. The thickness, size, etc. of components in figures may be different from components of an actual air separation apparatus.

(First Embodiment)

Figure 1:
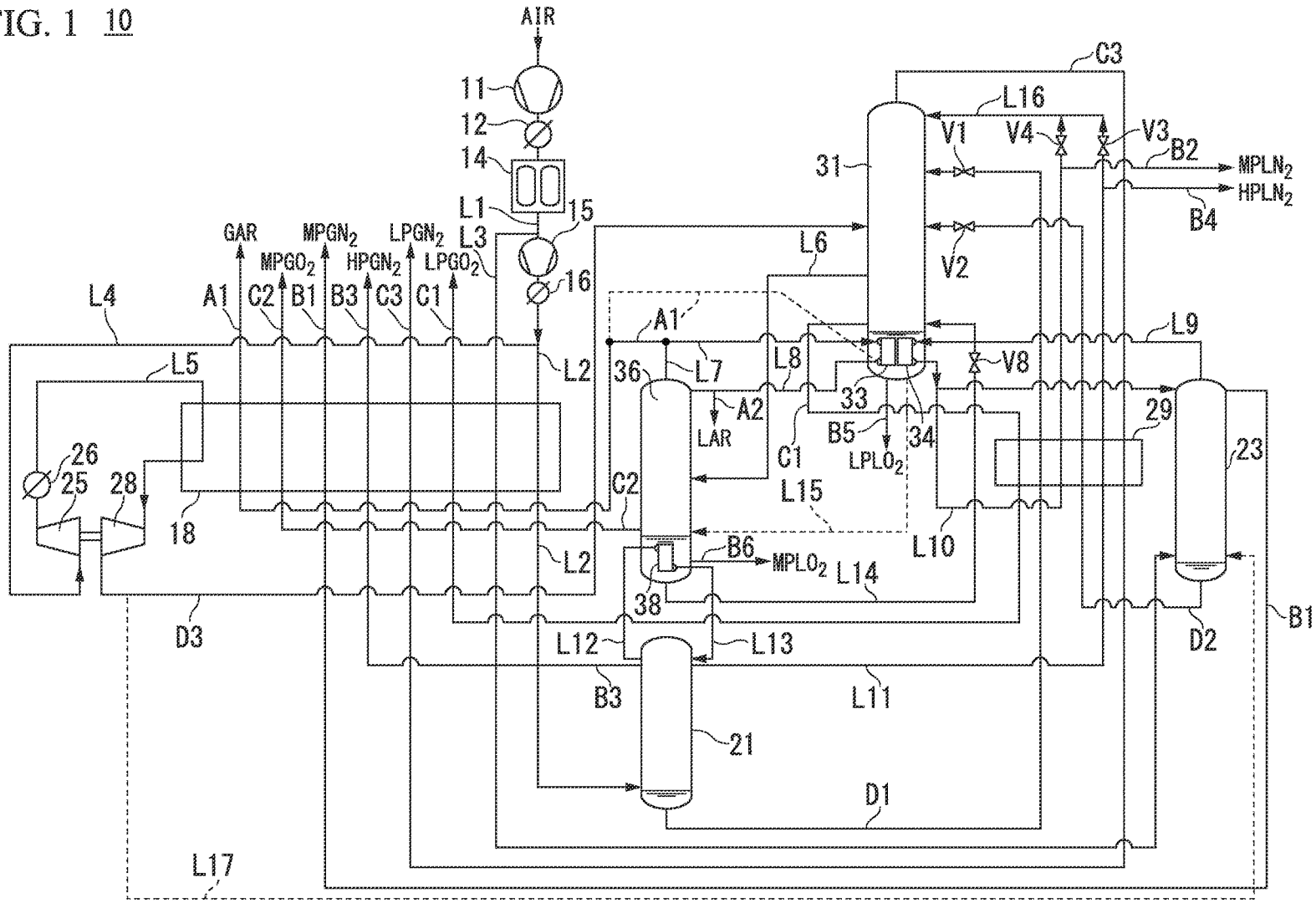
FIG. 1 is a schematic block diagram showing an air separation apparatus of the first embodiment according to the present invention.

FIG. 1 is a schematic block diagram showing an air separation apparatus of the first embodiment according to the present invention.

As shown in FIG. 1, the air separation apparatus 10 according to the first embodiment includes an air compressor 11, an air precooler 12, an air purifier 14, an air blower 15, an air blower aftercooler 16, a main heat exchanger 18, a high-pressure column 21, a middle-pressure column 23, a turbine blower 25, a turbine blower aftercooler 26, a turbine 28, a subcooler 29, a low-pressure column 31, a first low-pressure column reboiler 33, a second low-pressure column reboiler 34, an argon column 36, an argon column reboiler 38, a first product withdrawing lines A1 and A2, second product withdrawing lines B1 to B6, third product withdrawing lines C1 to C3, first to third low-pressure feed supply lines D1 to D3, and lines L1 to L17.

Moreover, in the present invention, "low-pressure" means a pressure of 400 kPaA or less which is equal to the operating pressure of the low-pressure column 31 or lower. "Middle-pressure" means pressure which is equal to the operating pressure of the middle-pressure column 23 or lower, and higher than the operating pressure of the low-pressure column 31. "High-pressure" means pressure which is higher than the operating pressure of the middle-pressure column 23.

The air compressor 11 is provided in the line L1. The air compressor 11 is connected to a feed air supply source (not shown in the figures) which supplies air (feed air) containing oxygen, nitrogen, and argon, and an air precooler 12 through the line L1.

The air compressor 11 compresses air containing oxygen, nitrogen, and argon. The air (feed air) compressed by the air compressor 11 is transferred to the air precooler 12 through the line L1.

One end of the line L1 is connected to the feed air supply source (not shown in the figures), and the other end thereof is connected to one end of the line L2 (the other end the line L2 is connected to the bottom part of the high-pressure column 21).

The air precooler 12 is provided in the line L1 between the air compressor 11 and the air purifier 14. The air precooler 12 is connected to the air compressor 11 and the air purifier 14 through the line 1.

The air precooler 12 removes compression heat of the air compressed by the air compressor 11. The air of which the compression heat is removed by the air precooler 12 is transferred to the air purifier 14 through the line L1.

The air purifier 14 is provided in the line L1 between the air precooler 12 and the air blower 15. The air purifier 14 is connected to the air precooler 12 and the air blower 15 through the line L1.

The air purifier 14 removes impurities (specifically, water, carbon dioxide, etc. for example) contained in the air of which the compression heat is removed by the air precooler 12. The air of which the impurities are removed by the air purifier 14 is transferred to the air blower 15 through the line L1 while being transferred to the line L3 branched from the line L1 between the air purifier 14 and the air blower 15.

The air blower 15 is provided in the line L1 between the air purifier 14 and the air blower aftercooler 16. The air blower 15 is connected to the air purifier 14 and the air blower aftercooler 16.

The air blower 15 further compresses a part of the air of which the impurities are removed. The air compressed by the air blower 15 is transferred to the air blower aftercooler 16 through the line L1.

The air blower aftercooler 16 is provided in the line L1 at the downstream side of air blower 15. The air blower aftercooler 16 is connected to the air blower 15 through the line L1.

The air blower aftercooler 16 removes compression heat of the air compressed by the air blower 15. A part of the air cooled by the air blower aftercooler 16 is supplied to the line L2, and the remainder thereof is supplied to the turbine blower 25 through the line L4 branched from one end of the line L1.

The main heat exchanger 18 is provided at a part of the lines L2, L3, L5, the first product withdrawing line A1, the second product withdrawing lines B1 and B3, and third product withdrawing lines C1 to C3.

The main heat exchanger 18 exchanges heat between high-temperature fluid flowing in the line L2, L3, and L5 and low-temperature fluid flowing in the first product withdrawing line A1, the second product withdrawing lines B1 and B3, the third product withdrawing lines C1 to C3, and thereby each high-temperature fluid is cooled, and each low-temperature fluid is heated.

The air cooled by the air blower aftercooler 16 is further cooled by the main heat exchanger 18, and thereby becomes high-pressure feed air (which is obtained by compressing, refining, and cooling air containing oxygen, nitrogen, and argon). The high-pressure feed air is supplied to the high-pressure column 21 through the line L2. The air in the line L3 which is branched from the line L1 is cooled by the main heat exchanger 18, and thereby becomes middle-pressure feed air (which is obtained by compressing, refining, and cooling air containing oxygen, nitrogen, and argon). The middle-pressure feed air is supplied into the middle-pressure column 23 through the line L3.

In addition, high-pressure turbine feed air (will be detailed later), which is cooled by the main heat exchanger 18, is supplied into the turbine 28 through the line L5.

The high-pressure column 21 is connected to one end of the line L2. The high-pressure column 21 distills at low temperatures and separates the high-pressure feed air to high-pressure nitrogen gas and high-pressure oxygen enriched liquefied air. By the low-temperature distillation, high-pressure nitrogen gas is concentrated at the upper part of the high-pressure column 21, and high-pressure oxygen enriched liquefied air is concentrated at the bottom part of the high-pressure column 21.

The bottom part of the high-pressure column 21 is connected to one end of the first low-pressure feed supply line D1 (the other end of the first low-pressure feed supply line D1 is connected to the upper part of the low-pressure column 31).

The high-pressure oxygen enriched liquefied air is supplied to the upper part of the low-pressure column 31 as the low-pressure feed through the first low-pressure feed supply line D1, the subcooler 29, and the decompression valve V1.

The top part of the high-pressure column 21 is connected to one end of the line L12 (the other end of the line L12 is connected to the argon column reboiler 38). The high-pressure nitrogen gas (high-pressure nitrogen gas before liquefaction in the argon column reboiler 38) in the high-pressure column 21 is supplied into the argon column reboiler 38 through the line L12.

The second product withdrawing line B3 is connected to the top part of the high-pressure column 21. A part of the second product withdrawing line B3 passes through the main heat exchanger 18. The second product withdrawing line B3 withdraws a part of the high-pressure nitrogen gas.

The second product withdrawing line B4 is branched from the line 11 which is positioned at the downstream side of the subcooler 29. The second product withdrawing line B4 withdraws high-pressure liquefied nitrogen which is liquefied in the argon column reboiler 38.

The line L16 is connected to one end of the lines L10 and L11. The line L16 is connected to the top part of the low-pressure column 31. The line L16 supplies fluid which is transferred by the lines L10 and L11 into the low-pressure column 31.

The middle-pressure column 23 is connected to the line L3. The middle-pressure column 23 distills at low temperatures and separates a part or the whole of the middle-pressure feed air to middle-pressure nitrogen gas and middle-pressure oxygen enriched liquefied air.

By low-temperature distillation, middle-pressure nitrogen gas is concentrated at the upper side of the middle-pressure column 23, and middle-pressure oxygen enriched liquefied air is concentrated at the bottom part of the middle-pressure column 23.

The bottom part of the middle-pressure column 23 is connected to one end of the second low-pressure feed supply line D2 (the other end of second low-pressure feed supply line D2 is connected to the central part of the low-pressure column 31). The middle-pressure oxygen enriched liquefied air is supplied to the central part of the low-pressure column 31 as low-pressure feed through the second low-pressure feed supply line D2, the subcooler 29, and the decompression valve V2.

The top part of the middle-pressure column 23 is connected to one end of the line L9 (the other end of the line L9 is connected to the second low-pressure column reboiler 34). The middle-pressure nitrogen gas in the middle-pressure column 23 is supplied into the second low-pressure column reboiler 34 through the line L9.

One end of the second product withdrawing line B1 is connected to the top part of the middle-pressure column 23. A part of the second product withdrawing line B1 passes through the main heat exchanger 18. The second product withdrawing line B1 withdraws middle-pressure nitrogen gas before liquefaction in the second low-pressure column reboiler 34.

The turbine blower 25 is connected to one end of the lines L4 and L5. The turbine blower 25 further compresses air transferred by the line L4, and makes high-pressure turbine feed air. The high-pressure turbine feed air which is compressed by the turbine blower 25 is transferred to the turbine 28 through the line L5, the turbine blower aftercooler 26, and the main heat exchanger 18.

The turbine blower aftercooler 26 cools the high-pressure turbine feed air which is compressed in the turbine blower 25. The high-pressure turbine feed air which is cooled in the turbine blower aftercooler 26 is transferred by the line L5, and further cooled in the main heat exchanger 18. After that, the high-pressure turbine feed air is supplied into the turbine 28.

The turbine 28 is connected to one end of the line L5 and the third low-pressure feed supply line D3 (the other end of the third low-pressure feed supply line D3 is connected to the central part of the low-pressure column 31).

The turbine 28 adiabatically expands the high-pressure turbine feed air which is passed through the turbine blower aftercooler 26 and the main heat exchanger 18, and makes low-pressure turbine air. The low-pressure turbine air is supplied to the central part of the low-pressure column 31 through the third low-pressure feed supply line D3.

The subcooler 29 is provided at a part of the first low-pressure feed supply line D1, the second low-pressure feed supply line D2, the lines L10 and L11, and the third product withdrawing lines C1 and C3.

The subcooler 29 indirectly exchanges heat between the high-temperature fluid flowing in the first low-pressure feed supply line D1, the second low-pressure feed supply line D2, and the lines L10 and L11 and the low-temperature fluid flowing in the third product withdrawing lines C1 and C3, and thereby cools the high-temperature fluid and heats the low-temperature fluid.

The low-pressure column 31 is connected to one end of the line L16, the first low-pressure feed supply line D1, the second low-pressure feed supply line D2, the third low-pressure feed supply line D3, the lines L6 and L14, the third product withdrawing lines C3 and C1, and the second product withdrawing line B5. To the top part of the low-pressure column 31, high-pressure liquefied nitrogen which is decompressed by the decompression valve V3 and middle-pressure liquefied nitrogen which is decompressed by the decompression valve V4 are supplied as reflux through the line L16.

To the upper part of the low-pressure column 31, high-pressure oxygen enriched liquefied air, which is cooled by the subcooler 29, and decompressed by the decompression valve V1, is supplied as low-pressure feed through the first low-pressure feed supply line D1.

Middle-pressure oxygen enriched liquefied air, which is cooled by the subcooler 29, and decompressed by the decompression valve V2, is supplied to the central part of the low-pressure column 31 through the second low-pressure feed supply line D2. Low-pressure turbine air, which is expanded by the turbine 28, is also supplied to the central part of the low-pressure column 31 through the third low-pressure feed supply line D3 as low-pressure feed.

To the lower part of the low-pressure column 31, middle-pressure liquefied oxygen, which is withdrawn from the bottom part of the argon column 36 and decompressed by the decompression valve V8, is supplied through the line L14.

The low-pressure column 31 distills the high-pressure oxygen enriched liquefied air, the middle-pressure oxygen enriched liquefied air, and the low-pressure feed (in other words, a mixed fluid containing oxygen, nitrogen, and argon) containing the low-pressure turbine air containing at low temperatures, and separates them to low-pressure nitrogen gas, low-pressure liquefied oxygen, and liquefied feed argon.

At this time, the low-pressure nitrogen gas is concentrated at the upper part of the low-pressure column 31, the low-pressure liquefied oxygen is concentrated at the bottom part of the low-pressure column 31, and the liquefied feed argon is concentrated at the lower part of the low-pressure column 31.

The lower part of the low-pressure column 31 is connected to the central part or the lower part of the argon column 36 through the line L6. The liquefied feed argon which is obtained by the separation in the low-pressure column 31 is supplied to the central part or the lower part of the argon column 36 through the line L6.

The third product withdrawing line C3 is connected to the top part of the low-pressure column 31. The third product withdrawing line C3 passes through the subcooler 29 and the main heat exchanger 18. The third product withdrawing line C3 withdraws low-pressure nitrogen gas (low-pressure nitrogen gas withdrawn from the top part of the low-pressure column 31), of which heat is recovered by the subcooler 29 and the main heat exchanger 18, as a product.

One end of the third product withdrawing line C1 is connected to the bottom part of the low-pressure column 31 where is upper than the first and second low-pressure column reboilers 33 and 34. In addition, a part of the third product withdrawing line C1 passes through the main heat exchanger 18 and the subcooler 29.

The third product withdrawing line C1 withdraws a part of the low-pressure oxygen gas, which is vaporized by the first and second low-pressure column reboilers 33 and 34.

One end of the second product withdrawing line B5 is connected to the bottom part of the low-pressure column 31 where is lower than the first and second low-pressure column reboilers 33 and 34. The second product withdrawing line B5 withdraws the low-pressure liquefied oxygen, which is not vaporized by the first and second low-pressure column reboilers 33 and 34.

The first low-pressure column reboiler 33 is positioned at the bottom part of the low-pressure column 31. The first low-pressure column reboiler 33 is connected to one end of the line L7 (the other end of the line L7 is connected to the top part of the argon column 36), and the line L8.

To the first low-pressure column reboiler 33, argon gas in the argon column 36 is supplied through the line L7.

The first low-pressure column reboiler 33 indirectly exchanges heat between a part or the whole of the argon gas supplied from the argon column 36 and the low-pressure liquefied oxygen in the low-pressure column 31. Thereby, the argon gas is liquefied, and liquefied argon is produced while the low-pressure liquefied oxygen is vaporized, and low-pressure oxygen gas is produced.

The first product withdrawing line A1 is branched from the line L7. A part of the first product withdrawing line A1 passes through the main heat exchanger 18. The first product withdrawing line A1 withdraws a part of argon gas before liquefaction.

In addition, the first product withdrawing line A1 may be a line branched from the line L8 at an exit of the first low-pressure column reboiler 33. In this case, the first product withdrawing line A1 withdraws argon gas which is not liquefied in first low-pressure column reboiler 33.

The first product withdrawing line A2 is branched from the line L8. The first product withdrawing line A2 withdraws liquefied argon flowing in the line L8.

The second low-pressure column reboiler 34 is arranged at the bottom part of the low-pressure column 31 so as to face first low-pressure column reboiler 33 each other. The second low-pressure column reboiler 34 is connected to one end of the line L9 (the other end of the line L9 is connected to the top part of the middle-pressure column 23), and the line L10.

To the second low-pressure column reboiler 34, a part or the whole of the middle-pressure nitrogen gas in the middle-pressure column 23 is supplied through the line L9.

The second low-pressure column reboiler 34 indirectly exchanges heat between a part or the whole of the middle-pressure nitrogen gas supplied from the middle-pressure column 23 and the low-pressure liquefied oxygen in the low-pressure column 31. Thereby, the middle-pressure nitrogen gas is liquefied, and the middle-pressure liquefied nitrogen is produced while the low-pressure liquefied oxygen is vaporized, and the low-pressure oxygen gas is produced.

The middle-pressure liquefied nitrogen produced in the second low-pressure column reboiler 34 is supplied to the line L10. A part of the line L10 passes through the subcooler 29.

The second product withdrawing line B2 is branched from the line L10. The second product withdrawing line B2 withdraws a part of the middle-pressure liquefied nitrogen which is liquefied in the second low-pressure column reboiler 34.

The argon column 36 is connected to one end of the lines L6, L7, L8, and L14, and the third product withdrawing line C2.

To the argon column 36, the liquefied feed argon in the low-pressure column 31 is supplied through the line L6. The argon column 36 distills the liquefied feed argon at low temperatures, and separates the liquefied feed argon to argon gas and middle-pressure liquefied oxygen.

At this time, argon gas is concentrated at the upper part of the argon column 36, and the middle-pressure liquefied oxygen is concentrated at the bottom part of the argon column 36.

The third product withdrawing line C2 is connected to the lower part of the argon column 36. The third product withdrawing line C2 withdraws the middle-pressure oxygen gas which is vaporized in the argon column reboiler 38.

The second product withdrawing line B6 is connected to the bottom part of the argon column 36. The second product withdrawing line B6 withdraws middle-pressure liquefied oxygen, which is not vaporized in the argon column reboiler 38.

The argon column reboiler 38 is arranged at the bottom part of the argon column 36. The argon column reboiler 38 is connected to one end of the line L12 of which the other end is connected to the top part of the high-pressure column 21, one end of the line L13 of which the other end is connected to the top part of the high-pressure column 21. To the argon column reboiler 38, a part or the whole of the high-pressure nitrogen gas in the high-pressure column 21 is supplied through the line L12.

The argon column reboiler 38 indirectly exchanges heat of a part or the whole of the high-pressure nitrogen gas and the middle-pressure liquefied oxygen in the argon column 36. Thereby, the high-pressure nitrogen gas is liquefied, and high-pressure liquefied nitrogen is produced while a part of the middle-pressure liquefied oxygen is vaporized, and the middle-pressure oxygen gas is produced.

The air separation apparatus of the first embodiment includes:

a low-pressure column 31 in which the mixed fluid containing oxygen, nitrogen, and argon, which is a low-pressure feed, is distilled at low temperatures, and separated into low-pressure nitrogen gas, low-pressure liquefied oxygen, and liquefied feed argon;

an argon column 36 in which the liquefied feed argon is distilled at low temperatures and separated into argon gas and middle-pressure liquefied oxygen;

the first low-pressure column reboiler 33 in which, by the indirect heat exchange between the argon gas and the low-pressure liquefied oxygen, the argon gas is liquefied, and liquefied argon is produced while a part of the low-pressure liquefied oxygen is vaporized, and low-pressure oxygen gas is produced;

the second low-pressure column reboiler 34 in which, by indirect heat exchange between middle-pressure nitrogen gas supplied from the middle-pressure column 23 and the low-pressure liquefied oxygen, the middle-pressure nitrogen gas is liquefied, and middle-pressure liquefied nitrogen is produced while a part of the low-pressure liquefied oxygen is vaporized, and low-pressure oxygen gas is produced;

the argon column reboiler 38 in which, by indirect heat exchange between high-pressure nitrogen gas supplied from the high-pressure column 21 and the middle-pressure liquefied oxygen, the high-pressure nitrogen gas is liquefied, and high-pressure liquefied nitrogen is produced while a part of the middle-pressure liquefied oxygen is vaporized, and middle-pressure oxygen gas is produced;

the first product withdrawing line A1 withdrawing a part of the argon gas before liquefaction in the first low-pressure column reboiler 33 or the argon gas which is not liquefied in the first low-pressure column reboiler 33 as a product;

the first product withdrawing line A2 withdrawing a part of the liquefied argon which is liquefied in the first low-pressure column reboiler 33 as a product:

the second product withdrawing line B5 withdrawing the low-pressure liquefied oxygen which is not vaporized in the first and second low-pressure column reboilers 33 and 34 as a product;

the second product withdrawing line B6 withdrawing the middle-pressure liquefied oxygen which is not vaporized in the argon column reboiler as a product;

the second product withdrawing line B1 withdrawing a part of the middle-pressure nitrogen gas as a product;

the second product withdrawing line B2 withdrawing a part of the middle-pressure liquefied nitrogen as a product;

the second product withdrawing line B3 withdrawing a part of the high-pressure nitrogen gas at the top part of the high-pressure column 21 as a product; and the second product withdrawing line B4 withdrawing a part of the high-pressure liquefied nitrogen at the top part of the high-pressure column 21 as a product.

As explained above, since the air separation apparatus includes the argon column 36 having higher pressure than that of the low-pressure column 31, it is possible to reboil the low-pressure liquefied oxygen at the bottom part of the low-pressure column 31 by not only the middle-pressure nitrogen gas at the top part of the middle-pressure column 23 but also the argon gas at the top part of the argon column 36.

Thereby, even when the high-pressure nitrogen gas is withdrawn from the upper part of the high-pressure column 21, the middle-pressure nitrogen gas is withdrawn from the upper part of the middle-pressure column 23, or the flow rate of the high-pressure feed air supplied into the high-pressure column 21 decreases by the increase of the flow rate of the high-pressure turbine feed air, it is possible to sufficiently maintain the amount of rising gas in the low-pressure column 31. Therefore, it is possible to inhibit a decrease of the argon recovery compared with the conventional air separation apparatus 200 shown in FIG. 6.

For example, when a large amount of the middle-pressure nitrogen gas is withdrawn from the top part of the middle-pressure column 23 in the conventional air separation apparatus, the argon recovery largely decreases (for example, 60%). However, when the same amount of the middle-pressure nitrogen gas is collected, it is possible to maintain high argon recovery (for example 80%) by using the air separation apparatus 10 of the first embodiment.

In addition, when the argon recovery is the same, it is possible to increase the flow rate of the high-pressure nitrogen gas, the middle-pressure nitrogen gas, the high-pressure turbine feed air, etc. in the air separation apparatus 10 of the first embodiment compared with the conventional air separation apparatus.

For example, when the argon recovery is maintained at 80%, the flow rate of the turbine feed air is about 10% of required feed air in the conventional air separation apparatus. However, the flow rate of the turbine feed air can be increased to 20% or more by using the air separation apparatus 10 of the first embodiment.

As a result, although the total flow rate of the liquefied gas product (in other words, the liquefied argon LAR, the low-pressure liquefied oxygen $LPLO_2$, the middle-pressure liquefied oxygen $MPLO_2$, the middle-pressure liquefied nitrogen $MPLN_2$, and the high-pressure liquefied nitrogen $HPLN_2$) is 1% or less relative to the flow rate of the feed air in the conventional air separation apparatus, it is possible to increase the total flow rate of the liquefied gas product to 3% or more relative to the flow rate of the feed air in the air separation apparatus of the first embodiment.

Moreover, the first product withdrawing lines A1 and A2 are included as the first product withdrawing line in the air separation apparatus 10 of the first embodiment. However, the air separation apparatus of the present invention may include at least one of the first product withdrawing lines A1 and A2 as the first product withdrawing line.

In addition, the air separation apparatus 10 of the first embodiment includes the second product withdrawing lines B1 to B6 as the second product withdrawing line. However, the air separation apparatus 10 of the present invention includes at least one of the second product withdrawing lines B1 to B6 as the second product withdrawing line.

In addition the air separation apparatus 10 of the first embodiment includes the first to third low-pressure feed supply lines D1 to D3 as the low-pressure feed supply line. However, the air separation apparatus 10 of the present invention may include at least one of the first to third low-pressure feed supply lines D1 to D3 as the low-pressure feed supply line.

Next, the air separation method of the first embodiment using the air separation apparatus 10 will be explained using FIG. 1.

First, air containing oxygen, nitrogen, and argon is compressed by the air compressor 11. Then, the compressed air is cooled to near normal temperature by the air precooler 12. After that, impurities, such as moisture, carbon dioxide, and so on contained in the air which is cooled to near normal temperature are removed by the air purifier 14.

A part of the air from which the impurities are removed is compressed by the air blower 15. The compression heat of the air compressed by the air blower 15 is removed by the air blower aftercooler 16. The air is cooled to near dew point by the main heat exchanger 18, and becomes the high-pressure feed air. The high-pressure feed air is supplied into the high-pressure column 21.

In the high-pressure column 21, by the gas-liquid contact between the high-pressure feed air and the high-pressure liquefied nitrogen supplied from the argon column reboiler 38, the high-pressure feed air distilled at low temperatures, and separated into high-pressure nitrogen gas at the top part of the high-pressure column 21 and high-pressure oxygen enriched liquefied air at the bottom part of the high-pressure column 21 (high-pressure nitrogen separation step).

A part of the concentrated high-pressure nitrogen gas at the top part of the high-pressure column 21 is supplied into the argon column reboiler 38 through the line L12. In the argon column reboiler 38, by the indirect heat exchange between a part or the whole of the high-pressure nitrogen gas supplied from the high-pressure column 21 and middle-pressure liquefied oxygen in the argon column 36, the high-pressure nitrogen gas is liquefied, and high-pressure liquefied nitrogen is produced while the middle-pressure liquefied oxygen is vaporized, and middle-pressure oxygen gas is produced (third indirect heat exchange step).

When the high-pressure nitrogen gas ($HPGN_2$) which is one of the products is collected, a part of the high-pressure nitrogen gas (high-pressure nitrogen gas before liquefaction in the third indirect heat exchange step) at the top part of the high-pressure column 21 is withdrawn to the second product withdrawing line B3. After heat recovery in the main heat exchanger 18, the high-pressure nitrogen gas is withdrawn as a product (second product withdrawing step)

A part of the high-pressure liquefied nitrogen which is liquefied in the argon column reboiler 38 becomes reflux in the high-pressure column 21. The remaining is withdrawn to the line L11, cooled by the subcooler 29, decompressed by the decompression valve V3, and introduced into the low-pressure column 31 as reflux.

When the high-pressure liquefied nitrogen ($HPLN_2$) which is one of the products is collected, a part of high-pressure liquefied nitrogen (product) which is cooled in the subcooler 29 is withdrawn through the second product withdrawing line B4 (second product withdrawing step).

The high-pressure oxygen enriched liquefied air, which is withdrawn from the bottom part of the high-pressure column 21 to the first low-pressure feed supply line D1, is cooled in the subcooler 29. After that, the cooled high-pressure oxygen enriched liquefied air is decompressed by the decompression valve V1, and supplied into the low-pressure column 31 as a low-pressure feed (a mixed fluid containing oxygen, nitrogen, and argon) (low-pressure feed supply step).

A part of the air passed through the air purifier 14 is supplied to the line L3, cooled to near dew point by the main heat exchanger 18, and becomes middle-pressure feed air. The middle-pressure feed air is supplied into the middle-pressure column 23. The middle-pressure feed air in the middle-pressure column 23 is distilled at low temperature by the gas-liquid contact with the middle-pressure liquefied nitrogen, and separated into the middle-pressure nitrogen gas at the top part of the middle-pressure column 23 and the middle-pressure oxygen enriched liquefied air at the bottom part of the middle-pressure column 23 (middle-pressure nitrogen separation step).

The middle-pressure nitrogen gas at the top part of the middle-pressure column 23 is supplied to the second low-pressure column reboiler 34 through the line L9.

In the second low-pressure column reboiler 34, by the indirect heat exchange between the low-pressure liquefied oxygen in the low-pressure column 31 and the middle-pressure nitrogen gas, the low-pressure liquefied oxygen is vaporized, and low-pressure oxygen gas is produced while the middle-pressure nitrogen gas is condensed, and middle-pressure liquefied nitrogen is produced (second indirect heat exchange step).

When the middle-pressure nitrogen gas ($MPGN_2$) which is one of the products is collected, a part of the middle-pressure nitrogen gas (middle-pressure nitrogen gas before liquefaction in the second indirect heat exchange step) at the top part of the middle-pressure column 23 is withdrawn to the second product withdrawing line B1. After heat recovery in the main heat exchanger 18, the middle-pressure nitrogen gas is withdrawn as a product (second product withdrawing step).

A part of the middle-pressure liquefied nitrogen which is liquefied in the second low-pressure column reboiler 34 becomes reflux in the middle-pressure column 23. The remaining is withdrawn to the line L10, cooled by the subcooler 29, decompressed by the decompression valve V4, and supplied to the low-pressure column 31 as reflux.

When the middle-pressure liquefied nitrogen ($MPLN_2$) which is one of the products is collected, a part of the middle-pressure liquefied nitrogen is withdrawn through the second product withdrawing line B2 branched from the line L10 (second product withdrawing step).

The middle-pressure oxygen enriched liquefied air, which is withdrawn from the bottom part of the middle-pressure column 23 to second low-pressure feed supply line D2, is cooled by subcooler 29, decompressed by the decompression valve V2, and supplied into the low-pressure column 31 as a low-pressure feed (low-pressure feed supply step).

A part of the air which is compressed and cooled by passing through the air blower 15 and the air blower aftercooler 16, is transferred by the line L4. The air transferred by the line L4 is compressed by the turbine blower 25, and becomes high-pressure turbine feed air. The high-pressure turbine feed air is transferred to the line L5. After recovering the compression heat by the turbine blower aftercooler 26, the high-pressure turbine feed air is cooled by the main heat exchanger 18, and introduced into the turbine 28.

The high-pressure turbine feed air introduced into the turbine 28 is adiabatically expanded to the operating pressure of the low-pressure column 31 and generates coldness, and thereby becomes low-pressure turbine air. The low-pressure turbine air is supplied into the low-pressure column 31 through the third low-pressure feed supply line D3 (low-pressure feed supply step).

Moreover, the turbine blower 25 has the same axis as that of the turbine 28. Therefore, it is possible to use power generated by expanding a part of the high-pressure feed air in the turbine 28 to drive the turbine blower 25.

In the low-pressure column 31, the low-pressure feed (in other words, the mixed fluid containing oxygen, nitrogen and argon) containing the high-pressure oxygen enriched liquefied air decompressed by the decompression valve V1, the middle-pressure oxygen enriched liquefied air decompressed by the decompression valve V2, and the low-pressure turbine air which is adiabatically expanded by the turbine 28 is distilled at low temperatures, and separated into the low-pressure nitrogen gas at the top part of the low-pressure column 31, the liquefied feed argon at the lower part of the low-pressure column 31, and the low-pressure liquefied oxygen at the bottom part of the low-pressure column 31 (low-pressure oxygen separation step).

The low-pressure nitrogen gas at the top part of the low-pressure column 31 is withdrawn to the third product withdrawing line C3. After heat recovery by the subcooler 29 and the main heat exchanger 18, the low-pressure nitrogen gas is collected as the low-pressure nitrogen gas ($LPGN_2$) which is one of the products.

The liquefied feed argon withdrawn from the lower part of the low-pressure column 31 is supplied to the central part or the lower part of the argon column 36 through the line L6.

At this time, it is preferable that the amount of the nitrogen component in the liquefied feed argon be 500 ppm or less in volume ratio. In addition, it is preferable that the amount of the argon component in the liquefied feed argon be in a range from 3% to 20% in volume ratio.

In the argon column 36, the liquefied feed argon is distilled at low temperatures, and separated into the argon gas at the top part of the argon column 36, and the middle-pressure liquefied oxygen at the bottom part of the argon column 36 (argon separation step).

In the first low-pressure column reboiler 33, by the indirect heat exchange between a part or the whole of the argon gas supplied from the argon column 3 and the low-pressure liquefied oxygen in the low-pressure column 31, the argon gas is liquefied, and liquefied argon is produced while the low-pressure liquefied oxygen is vaporized, and low-pressure oxygen gas is produced (first indirect heat exchange step).

The liquefied argon which is liquefied in the first indirect heat exchange step is supplied into the argon column 36 through the line L8. The liquefied argon supplied in the argon column 36 becomes reflux in the argon column 36.

When the argon gas (GAR) which is one of the products is collected, a part of the argon gas (the argon gas before liquefaction in the first indirect heat exchange step) or the argon gas which is not liquefied in the first indirect heat exchange step (specifically, the argon gas which is obtained by the gas-liquid separation of the gas-liquid two phase argon fluid produced by the partial liquefactions in the first indirect heat exchange step) is withdrawn to the first product withdrawing line A1. After heat recovery by the main heat exchange 18, the argon gas is withdrawn as a product (first product withdrawing step).

In addition, when the liquefied argon (LAR) which is one of the products is collected, a part of the liquefied argon is withdrawn thought the first product withdrawing line A2 (first product withdrawing step).

When the low-pressure oxygen gas ($LPGO_2$) which is one of the products is collected, a part of the low-pressure oxygen gas (a part of low-pressure liquefied oxygen which is vaporized in the first and second indirect heat exchange step) is withdrawn to the third product withdrawing line C1. After heat recovery by the subcooler 29 and the main heat exchanger 18, the low-pressure oxygen gas is withdrawn as a product.

When the low-pressure liquefied oxygen ($LPLO_2$) which is one of the products is collected, the low-pressure liquefied oxygen, which is not vaporized in the first and second indirect heat exchange steps, is withdrawn through the second product withdrawing line B5 (second product withdrawing step).

When the middle-pressure oxygen gas ($MPGO_2$) which is one of the products is collected, a part of the middle-pressure oxygen gas, which is vaporized by the argon column reboiler 38, is withdrawn to the third product withdrawing line C2. After heat recovery by the main heat exchanger 18, the middle-pressure oxygen gas is withdrawn as a product.

When the low-pressure liquefied oxygen ($MPLO_2$) which is one of the products is collected, the middle-pressure liquefied oxygen, which is not vaporized in the third indirect heat exchange step, is withdrawn to the second product withdrawing line B6, and then withdrawn as a product (second product withdrawing step).

In addition, in order to adjust the L/V balance in the lower part of the low-pressure column 31 than the liquefied feed argon withdrawing part and lower part of the argon column 36 than the liquefied feed argon introduction part, there is a case that the middle-pressure liquefied oxygen, which is not vaporized in the argon column reboiler 38, is introduced into the bottom part of the low-pressure column 31 through the line L14 (the line L14 connects between the bottom part of the argon column 36 and the bottom part of the low-pressure column 31). In addition, in that case, there is a case that the low-pressure liquefied oxygen which is not vaporized in the first and second low-pressure column reboilers 33 and 34, is introduced into the bottom part of the argon column 36 through the line L15.

For example, when the L/V of the lower part of the argon column 36 than the liquefied feed argon introduction part is desired to be larger and the L/V of the lower part of the low-pressure column 31 than the liquefied feed argon withdrawing part is desired to be smaller without changing the heat exchange duty of the argon column reboiler 38, the first low-pressure column reboiler 33, and the second low-pressure column reboiler 34, the flow rate of the liquefied feed argon flowing in the line L6 may be increased while the flow rate of the middle-pressure liquefied oxygen flowing in the line L14 may be increased or the flow rate of the low-pressure liquefied oxygen flowing in the line L15 may be decreased.

As explained above, since the high-pressure column 21, the middle-pressure column 23, the low-pressure column 31, and the argon column 36 are thermally integrated by the indirect heat exchange steps, the operating pressure in the columns are increased in an order of the low-pressure column 31, the argon column 36, the middle-pressure column 23, and the high-pressure column 21.

Therefore, when a liquefied gas fluid is supplied from the distillation column having a lower operating pressure to the distillation column having a higher operating pressure (for example, a liquefied gas fluid is supplied to the line L6 and so on), the liquefied gas fluid can be transferred by using a liquefied gas pump (not shown in the figures) arranged in the fluid lines or the fluid head difference between the distillation columns.

In contrast, in a case that a liquefied gas fluid is supplied from the distillation column having a higher operating pressure to the distillation column having a lower operating pressure, and when the liquefied gas fluid cannot be transferred only by the difference in the operating pressure of the distillation columns because the fluid head difference is too large in a layout, a liquefied gas pump can be used.

Not shown in the figures, coldness, which is necessary to operate the air separation apparatus 10, can be produced by introducing a part of the air at the exit of the air purifier 14, instead of the air at the exit of the air blower aftercooler 16, into the turbine 28 through the turbine blower 25, the turbine blower aftercooler 26, and the main heat exchanger 18 to adiabatically expand.

In addition, there is a case that the pressure at the exit of the turbine 28 is adjusted to about operating pressure of the middle-pressure column 23 and the middle-pressure turbine air withdrawn from the turbine 28 is supplied into the lower part of the middle-pressure column 23 through the line L17 shown by a broken line in FIG. 1.

In addition, not shown in the figures, there is a case that coldness can be produced by introducing the middle-pressure nitrogen gas, which is withdrawn from the upper part of the middle-pressure column 23, instead of the air at the exit of the air blower aftercooler 16, into the turbine 28 through the main heat exchanger 18, the turbine blower 25, the turbine blower aftercooler 26, and the main heat exchanger 18 to adiabatically expand the middle-pressure nitrogen gas.

In this case, a low-pressure turbine nitrogen gas which is withdrawn from the turbine 28 becomes a part of the low-pressure nitrogen gas ($LPGN_2$) which is one of the products, after heat recovery in the main heat exchanger 18.

In addition, not shown in the figures, coldness can be produced by introducing the high-pressure nitrogen gas, which is withdrawn from the upper portion of the high-pressure column 21, instead of the air at the exit of the air blower aftercooler 16, into the turbine 28 thought the main heat exchanger 18, the turbine blower 25, the turbine blower aftercooler 26, and the main heat exchanger 18 to adiabatically expand.

At this time, when the pressure at the exit of the turbine 28 is about the operating pressure of the low-pressure column 31, the low-pressure turbine nitrogen gas which is withdrawn from the turbine 28 becomes a part of the low-pressure nitrogen gas ($LPGN_2$), which is one of the products, after heat recovery by the main heat exchanger 18.

In addition, not shown in the figures, when the pressure at the exit of the turbine 28 is about the operating pressure of the middle-pressure column 23, a middle-pressure turbine nitrogen gas, which is withdrawn from the turbine 28, becomes a part of the middle-pressure nitrogen gas ($MPGN_2$) which is one of the products, after heat recovery by the main heat exchanger 18. Otherwise, after heat recovery, the middle-pressure turbine nitrogen gas is introduced into the upper part of the middle-pressure column 23, or the second low-pressure column reboiler 34.

Furthermore, not shown in the figures, the coldness may be supplied by the introduction of the liquefied oxygen or the liquefied nitrogen from a liquefied gas storage tank or a liquefied gas production apparatus.

The argon concentration in the argon gas or the liquefied argon, which are the products, is preferably 50% by volume or more, and more preferably 95% by volume or more.

As explained above, the argon gas and the liquefied argon are collected as a product as it is. In addition, the argon gas and the liquefied argon may be collected as a product after removing the impurities, such as an oxygen component, a nitrogen component, and so on by providing an argon purifier.

In addition, even when the argon gas or the liquefied argon, which is one of the products, is not necessary, it is possible to improve the yield of oxygen by collecting the argon gas.

The air separation method of the first embodiment includes:

a low-pressure oxygen separation step in which a mixed fluid containing oxygen, nitrogen, and argon, which is a low-pressure feed, is distilled at low temperatures, and the mixed fluid is separated into low-pressure nitrogen gas, low-pressure liquefied oxygen, and liquefied feed argon;

an argon separation step in which the liquefied feed argon is distilled at low temperatures, and separated into argon gas and middle-pressure liquefied oxygen;

a first indirect heat exchange step in which, by indirect heat exchange between the argon gas and the low-pressure liquefied oxygen, the argon gas is liquefied and liquefied argon is produced while a part of the low-pressure liquefied oxygen is vaporized, and low-pressure oxygen gas is produced;

a second indirect heat exchange step in which, by indirect heat exchange between middle-pressure nitrogen gas supplied from a middle-pressure column and the low-pressure liquefied oxygen, the middle-pressure nitrogen gas is liquefied, and middle-pressure liquefied nitrogen is produced while a part of the low-pressure liquefied oxygen is vaporized, and low-pressure oxygen gas is produced;

a third indirect heat exchange step in which, by indirect heat exchange between high-pressure nitrogen gas supplied from a high-pressure column and the middle-pressure liquefied oxygen, the high-pressure nitrogen gas is liquefied, and high-pressure liquefied nitrogen is produced while a part of the middle-pressure liquefied oxygen is vaporized, and middle-pressure oxygen gas is produced;

a first product withdrawing step in which at least one kind of argon among a part of the argon gas which is before liquefaction in the first indirect heat exchange, a part of the argon gas which is not liquefied in the first indirect heat exchange step, and the liquefied argon is withdrawn as a product; and a second product withdrawing step in which at least one among the low-pressure liquefied oxygen which is not vaporized in the first and second indirect heat exchange steps, the middle-pressure liquefied oxygen which is not vaporized in the third indirect heat exchange step, a part of the middle-pressure nitrogen gas, a part of the middle-pressure liquefied nitrogen, a part of the high-pressure nitrogen gas at the top part of the high-pressure column, and a part of the high-pressure liquefied nitrogen at the top part of the high-pressure column, is withdrawn as a product.

As explained above, since the argon column 36 having higher pressure than that of the low-pressure column 31 is included, it is possible to reboil the low-pressure liquefied oxygen at the bottom part of the low-pressure column 31 by not only the middle-pressure nitrogen gas at the top part of the middle-pressure column 23 but also the argon gas at the top part of the argon column 36.

Thereby, even when the high-pressure nitrogen gas is withdrawn from the upper part of the high-pressure column 21, the middle-pressure nitrogen gas is withdrawn from the upper part of the middle-pressure column 23, or the flow rate of the high-pressure feed air supplied into the high-pressure column 21 decreases due to the increase in the flow rate of the high-pressure turbine feed air, it is possible to sufficiently maintain the amount of the rising gas in the low-pressure column 31. Therefore, it is possible to inhibit the decrease of the argon recovery compared with the conventional air separation apparatus 200 shown in FIG. 6.

For example, when a large amount of the middle-pressure nitrogen gas is withdrawn from the top part of the middle-pressure column 23 in the conventional air separation apparatus 200, the argon recovery largely decreases (for example, 60%). However, when the same amount of the middle-pressure nitrogen gas is collected, it is possible to maintain a high argon recovery (for example 80%) by using the air separation apparatus 10 of the first embodiment.

In addition, when the argon recovery is the same, it is possible to increase the flow rate of the high-pressure nitrogen gas, the middle-pressure nitrogen gas, the high-pressure turbine feed air, and so on compared with the conventional air separation apparatus 200.

For example, when the argon recovery is maintained at 80%, the flow rate of the feed air which can be supplied into the turbine is about 10% in the conventional air separation apparatus 200. However, the flow rate of the feed air can be increased to 20% or more by using the air separation apparatus 10 of the first embodiment.

As a result, although the total flow rate of the liquefied gas product (in other words, the liquefied argon LAR, the low-pressure liquefied oxygen $LPLO_2$, the middle-pressure liquefied oxygen $MPLO_2$, the middle-pressure liquefied nitrogen $MPLN_2$, and the high-pressure liquefied nitrogen $HPLN_2$) is 1% or less relative to the flow rate of the feed air in the conventional air separation apparatus 200, it is possible to increase the total flow rate of the liquefied gas product to 3% or more relative to the flow rate of the feed air in the air separation apparatus of the first embodiment.

(Second Embodiment)

Figure 2:
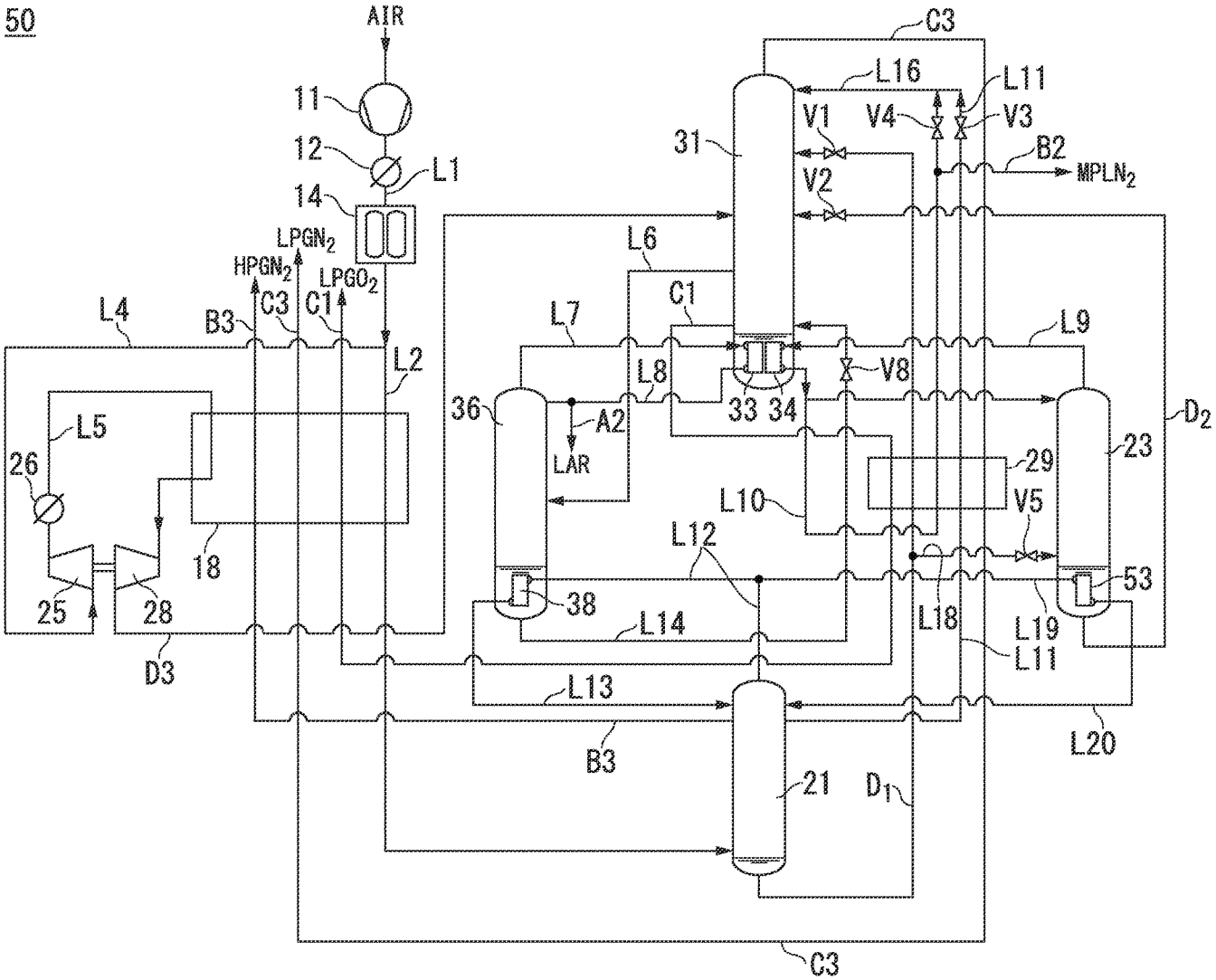
FIG. 2 is a schematic block diagram showing an air separation apparatus of the second embodiment according to the present invention.

FIG. 2 is a schematic block diagram showing an air separation apparatus 50 of the second embodiment according to the present invention. The same components of the air separation apparatus 50 in FIG. 2 as those in the air separation apparatus 10 shown in FIG. 1 have the same reference number as shown in FIG. 1. Thereby, an explanation for those same components is omitted in this embodiment.

As shown in FIG. 2, the air separation apparatus 50 of the second embodiment has the same structure as that of the air separation apparatus 10 of the first embodiment except that the air separation apparatus 50 of the second embodiment does not include the air blower 15, the air blower aftercooler 16, the first product withdrawing line A1, the second product withdrawing lines B1, B4, B5, and B6, the third product withdrawing line C2, and the line L3, and includes lines L18 to L20, a decompression valve V5, and a first middle-pressure column reboiler 53.

The line L18 is branched from the first low-pressure feed supply line D1. The line L18 is connected to the lower part of the middle-pressure column 23 through the decompression valve V5.

The feed (middle-pressure feed) in the middle-pressure column 23 is the high-pressure oxygen enriched liquefied air at the bottom part of the high-pressure column 21. The high-pressure oxygen enriched liquefied air at the bottom part of the high-pressure column 21 is withdrawn from the high-pressure column 21 to the first low-pressure feed supply line D1, introduced to the line L18 which is branched from the first low-pressure feed supply line D1, decompressed by the decompression valve V5, and supplied into the middle-pressure column 23.

The first middle-pressure column reboiler 53 is arranged at the bottom part of the middle-pressure column 23. The first middle-pressure column reboiler 53 is connected to the line L19 which is branched from the line L12. In addition, the first middle-pressure column reboiler 53 is connected to the line L20 of which the other end is connected to the top part of the high-pressure column 21.

In the first middle-pressure column reboiler 53, the indirect heat exchange is carried out between the middle-pressure oxygen enriched liquefied air at the lower part of the middle-pressure column 23 and a part of the high-pressure nitrogen gas introduced from the upper part of the high-pressure column 21 (fourth indirect heat exchange step).

Thereby, a part of the middle-pressure oxygen enriched liquefied air is vaporized, and middle-pressure oxygen enriched air is produced while the high-pressure nitrogen gas is liquefied, and high-pressure liquefied nitrogen is produced.

The middle-pressure oxygen enriched air produced in the first middle-pressure column reboiler 53 becomes a rising gas in the middle-pressure column 23. The rising gas is distilled by the gas-liquid contact with the middle-pressure liquefied nitrogen introduced at the top part of the middle-pressure column 23. Thereby, the nitrogen component is concentrated at the top part of the middle-pressure column 23.

The middle-pressure oxygen enriched liquefied air, which is not vaporized in the first middle-pressure column reboiler 53, is withdrawn to the second low-pressure feed supply line D2, decompressed by the decompression valve V2, and supplied into the low-pressure column 31 as the low-pressure feed (low-pressure feed supply step).

In addition, the high-pressure oxygen enriched liquefied air, which is introduced to the first low-pressure feed supply line D1, is decompressed by the decompression valve V1, and supplied into the low-pressure column 31 as the low-pressure feed (low-pressure feed supply step).

The high-pressure liquefied nitrogen produced in the first middle-pressure column reboiler 53 is withdrawn to the line L20, and supplied into the high-pressure column 21. One end of the line L11 is connected to the upper part of the high-pressure column 21, and the other end is connected to the line L16 through the subcooler 29, and the decompression valve V3. However, the line L11 may be branched from the line L20 and connected to the line L16 through the subcooler 29, and the decompression valve V3. In this case, a part or the whole of the high-pressure liquefied nitrogen, which is produced in the first middle-pressure column reboiler 53, becomes reflux in the low-pressure column 31 through the line L20, the line L11, and the line L16.

The air separation apparatus 50 of the second embodiment does not include the air blower 15, the air blower aftercooler 16, and the line L3 which are included in the air separation apparatus 10 of the first embodiment. Instead, the air separation apparatus 50 of the second embodiment includes the line L18 which decompresses a part or the whole of the high-pressure oxygen enriched liquefied air and supplies the decompressed high-pressure oxygen enriched liquefied air into the lower part of the middle-pressure column 23, and the first middle-pressure column reboiler 53 in which, by the indirect heat exchange between a part of the high-pressure nitrogen gas and the middle-pressure oxygen enriched liquefied air, a part of the high-pressure nitrogen gas is liquefied while a part of the middle-pressure oxygen enriched liquefied air is vaporized, which are not included in the air separation apparatus 10 of the first embodiment. Thereby, it is possible to distill the high-pressure oxygen enriched liquefied air, which is withdrawn from the bottom part of the high-pressure column 21, in the middle-pressure column 23.

Thereby, it is possible to produce the middle-pressure oxygen enriched liquefied air having a higher oxygen concentration than that of the middle-pressure oxygen enriched liquefied air obtained by the air separation apparatus 10 of the first embodiment. At the same time, it is possible to supply the middle-pressure oxygen enriched liquefied air into the low-pressure column 31. Thereby, the rectification conditions at the lower part (a part for concentrating oxygen) of the low-pressure column 31 can be improved. Due to this, it is possible to improve the argon recovery, liquefied gas products, middle-pressure nitrogen gas or high-pressure nitrogen gas.

The air separation method of the second embodiment using the air separation apparatus 50 can be carried out in the same manner as the air separation method of the first embodiment using the air separation apparatus 10 except that the air separation method of the second embodiment does not include: the compression step of further compressing the air refined in the air purifier 14 in the air blower 15; the cooling step of cooling the further compressed air in the air blower aftercooler 16; and the supplying step of supplying a part of the air refined in the air purifier 14 into the middle-pressure column 23 through the line L3, and includes: the supplying step of supplying the high-pressure oxygen enriched liquefied air into the middle-pressure column 23 through the line L18; and the fourth indirect heat exchange step which is explained above.

The air separation method of the second embodiment does not include a compression step of further compressing the air refined in the air purifier 14 in the air blower 15; the cooling step of cooling the further compressed air in the air blower aftercooler 16; and the supplying step of supplying a part of the air refined in the air purifier 14 into the middle-pressure column 23 through the line L3, and includes the supplying step of supplying the high-pressure oxygen enriched liquefied air into the middle-pressure column 23 through the line L18; and the fourth indirect heat exchange step of vaporizing a part of the middle-pressure oxygen enriched liquefied air. Thereby, it is possible to distill the high-pressure oxygen enriched liquefied air, which is withdrawn from the bottom part of the high-pressure column 21, in the middle-pressure column 23.

Thereby, it is possible to produce the middle-pressure oxygen enriched liquefied air having a higher oxygen concentration than that of the middle-pressure oxygen enriched liquefied air obtained by the air separation method of the first embodiment. At the same time, it is possible to supply the middle-pressure oxygen enriched liquefied air into the low-pressure column 31. Thereby, the rectification conditions at the lower part (a part for concentrating oxygen) of the low-pressure column 31 can be improved. Due to this, it is possible to improve the argon recovery, liquefied gas products, middle-pressure nitrogen gas or high-pressure nitrogen gas.

Moreover, the air separation apparatus 50 of the second embodiment can obtain the same effects as those of the air separation apparatus 10 of the first embodiment. In addition, the air separation method of the second embodiment can also obtain the same effects as those of the air separation method of the first embodiment.

(Third Embodiment)

Figure 3:
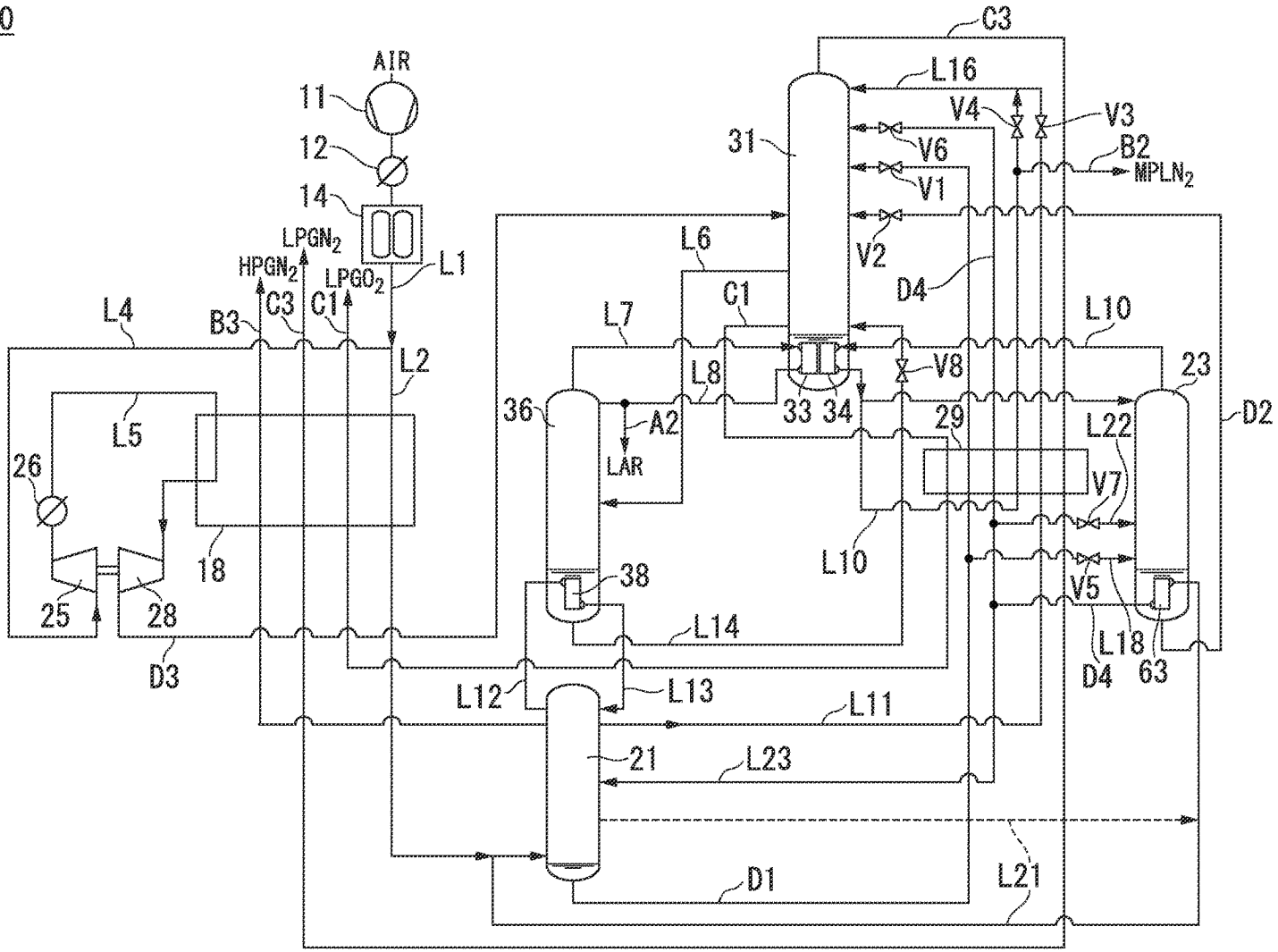
FIG. 3 is a schematic block diagram showing an air separation apparatus of the third embodiment according to the present invention.

FIG. 3 is a schematic block diagram showing an air separation apparatus 60 of the second embodiment according to the present invention. The same components of the air separation apparatus 60 in FIG. 3 as those in the air separation apparatus 50 shown in FIG. 2 have the same reference number as shown in FIG. 2. Thereby, an explanation for those same components is omitted in this embodiment.

As shown in FIG. 3, the air separation apparatus 60 of the third embodiment has the same structure as that of the air separation apparatus 50 of the second embodiment except that the air separation apparatus 60 of the third embodiment includes a second middle-pressure column reboiler 63, a fourth low-pressure feed supply line D4, lines L21 to L23, and decompression valves V6 and V7 instead of the first middle-pressure column reboiler 53, and the lines L19 and L20 of the air separation apparatus 50 of the second embodiment.

The second middle-pressure column reboiler 63 is arranged at the bottom part of the middle-pressure column 23. The second middle-pressure column reboiler 63 is connected to the line L21 and the fourth low-pressure feed supply line D4.

In the second middle-pressure column reboiler 63, the indirect heat exchange is carried out between a part of the high-pressure feed air or a part of high-pressure nitrogen enriched air, which rises in the high-pressure column 21, and the middle-pressure oxygen enriched liquefied air (fifth indirect heat exchange step).

Thereby, second middle-pressure column reboiler 63 makes a part of the high-pressure feed air or a part of the high-pressure nitrogen enriched air liquefy, and produces the high-pressure liquefied air or the high-pressure nitrogen enriched liquefied air while making a part of the middle-pressure oxygen enriched liquefied air vaporize and producing the middle-pressure oxygen enriched air.

One end of the fourth low-pressure feed supply line D4 is connected to the second middle-pressure column reboiler 63, and the other end is connected to the upper part of the low-pressure column 31. The fourth low-pressure feed supply line D4 is provided with the decompression valve V6.

The fourth low-pressure feed supply line D4 supplies the high-pressure liquefied air or the high-pressure nitrogen enriched liquefied air, which is produced by the second middle-pressure column reboiler 63, into the low-pressure column 31.

The line L21 is branched from the line L2 which transfers the high-pressure feed air. The line L21 is connected to the second middle-pressure column reboiler 63. Thereby, the line L21 supplies a part of the high-pressure feed air to the second middle-pressure column reboiler 63.

In addition, the line L21 may also be connected to the lower part of the high-pressure column 21. In this case, the line L21 supplies a part of high-pressure nitrogen enriched air, which rises in the high-pressure column 21, to the second middle-pressure column reboiler 63.

The line L22 is branched from the fourth low-pressure feed supply line D4. The line L22 is connected to the central part of the middle-pressure column 23 through the decompression valve V7. The line L22 supplies the high-pressure liquefied air or the high-pressure nitrogen enriched liquefied air, which is produced by the second middle-pressure column reboiler 63, into the middle-pressure column 23.

The line L23 is branched from the fourth low-pressure feed supply line D4, and is connected to the central part of the high-pressure column 21. The line L23 supplies the high-pressure liquefied air or the high-pressure nitrogen enriched liquefied air, which is produced by the second middle-pressure column reboiler 63, into the high-pressure column 21.

However, the lines L22 and L23, and the decompression valve V7 are not always necessary.

The air separation apparatus 60 of the third embodiment includes the second middle-pressure column reboiler 63 which is arranged at the bottom part of the middle-pressure column 23, and connected to the line L21 and the fourth low-pressure feed supply line D4, instead of the first middle-pressure column reboiler 53, which is connected to the lines L19 and L20 of the air separation apparatus 50 of the second embodiment. Thereby, it is possible to indirectly exchange heat between the high-pressure feed air or the high-pressure nitrogen enriched air, which has higher temperature than that of the high-pressure nitrogen gas, and the middle-pressure oxygen enriched liquefied air.

Thereby, it is possible to produce the middle-pressure oxygen enriched liquefied air, which has higher temperature (in other words, which has a higher oxygen concentration) than that of the middle-pressure oxygen enriched liquefied air in the air separation apparatus 50 of the second embodiment. At the same time, it is also possible to supply the middle-pressure oxygen enriched liquefied air having a higher oxygen concentration into the low-pressure column 31.

Thereby, the rectification conditions at the lower part (a part for concentrating oxygen) of the low-pressure column 31 can be improved. Due to this, it is possible to improve the argon recovery, liquefied gas products, middle-pressure nitrogen gas or high-pressure nitrogen gas.

As explained above, in the air separation apparatus 50 of the second embodiment, the first middle-pressure column reboiler 53 makes the high-pressure nitrogen gas liquefy and produces the high-pressure liquefied nitrogen, and the produced high-pressure liquefied nitrogen is supplied to the top part of the low-pressure column 31. However, in the air separation apparatus 60 of the third embodiment, the middle-pressure column reboiler 63 condenses the high-pressure feed air or the high-pressure nitrogen enriched air, which has a lower nitrogen concentration than that of the high-pressure nitrogen gas, and produces the high-pressure liquefied air or the high-pressure nitrogen enriched liquefied air, and the produced high-pressure liquefied air or the high-pressure nitrogen enriched liquefied air is supplied into the upper part of the low-pressure column 31.

Due to this, the rectification conditions at the upper part (a part for concentrating nitrogen) of the low-pressure column 31 are deteriorated and this deterioration makes the oxygen yield lower.

However, in this situation, the rectification conditions at the lower part of the low-pressure column 31 can be improved. Therefore, the rectification conditions are totally improved in the air separation apparatus 60, and the argon recovery, the liquefied gas products, the middle-pressure nitrogen gas or the high-pressure nitrogen gas is improved.

The air separation method according to the third embodiment using the air separation apparatus 60 is carried out in the same manner as the air separation method according to the second embodiment except that the air separation method according to the third embodiment includes the fifth indirect heat exchange step in which, by the indirect heat exchange between a part of the high-pressure feed air or a part high-pressure nitrogen enriched air, which rises in the high-pressure column 21, and the middle-pressure oxygen enriched liquefied air, a part or the high-pressure feed air or a part of the high-pressure nitrogen enriched air is liquefied, and the high-pressure liquefied air or the high-pressure nitrogen enriched liquefied air is produced while a part of the middle-pressure oxygen enriched liquefied air is vaporized, and the middle-pressure oxygen enriched air is produced, instead of the fourth indirect heat exchange step of the air separation method of the second embodiment.

Since the air separation method of the third embodiment includes the fifth indirect heat exchange step instead of fourth indirect heat exchange step in the air separation method of the second embodiment, it is possible to indirectly exchange heat between the high-pressure feed air or the high-pressure nitrogen enriched air which has higher temperature than that of the high-pressure nitrogen gas, and the middle-pressure oxygen enriched liquefied air.

Thereby, it is possible to produce the middle-pressure oxygen enriched liquefied air, which has higher temperature (in other words, which has a higher oxygen concentration) than that of the middle-pressure oxygen enriched liquefied air in the air separation method of the second embodiment. At the same time, it is also possible to supply the middle-pressure oxygen enriched liquefied air having a higher oxygen concentration into the low-pressure column 31.

Thereby, the rectification conditions at the lower part (a part for concentrating oxygen) of the low-pressure column 31 can be improved. Due to this, it is possible to improve the argon recovery, liquefied gas products, middle-pressure nitrogen gas or high-pressure nitrogen gas.

As explained above, in the fourth indirect heat exchange step of the air separation method of the second embodiment, the high-pressure nitrogen gas is liquefied, the high-pressure liquefied nitrogen is produced, and the produced high-pressure liquefied nitrogen is supplied to the top part of the low-pressure column 31. However, in the fifth indirect heat exchange step of the air separation method of the third embodiment, the high-pressure feed air or the high-pressure nitrogen enriched air, which has a lower nitrogen concentration than that of the high-pressure nitrogen gas, is condensed, and the high-pressure liquefied air or the high-pressure nitrogen enriched liquefied air is produced. The produced high-pressure liquefied air or high-pressure nitrogen enriched liquefied air is supplied into the upper part of the low-pressure column 31.

Due to this, the rectification conditions at the upper part (a part for concentrating nitrogen) of the low-pressure column 31 are deteriorated and this deterioration makes the oxygen yield lower.

However, in this situation, the rectification conditions at the lower part of the low-pressure column 31 can be improved. Therefore, the rectification conditions are totally improved in the air separation apparatus 60, and the argon recovery, the liquefied gas products, the middle-pressure nitrogen gas or the high-pressure nitrogen gas is improved.

Moreover, the air separation apparatus 60 of the third embodiment can obtain the same effects as those of the air separation apparatus 10 and 50 of the first and second embodiments. In addition, the air separation method of the third embodiment can also obtain the same effects as those of the air separation methods of the first and second embodiments.

(Fourth Embodiment)

Figure 4:
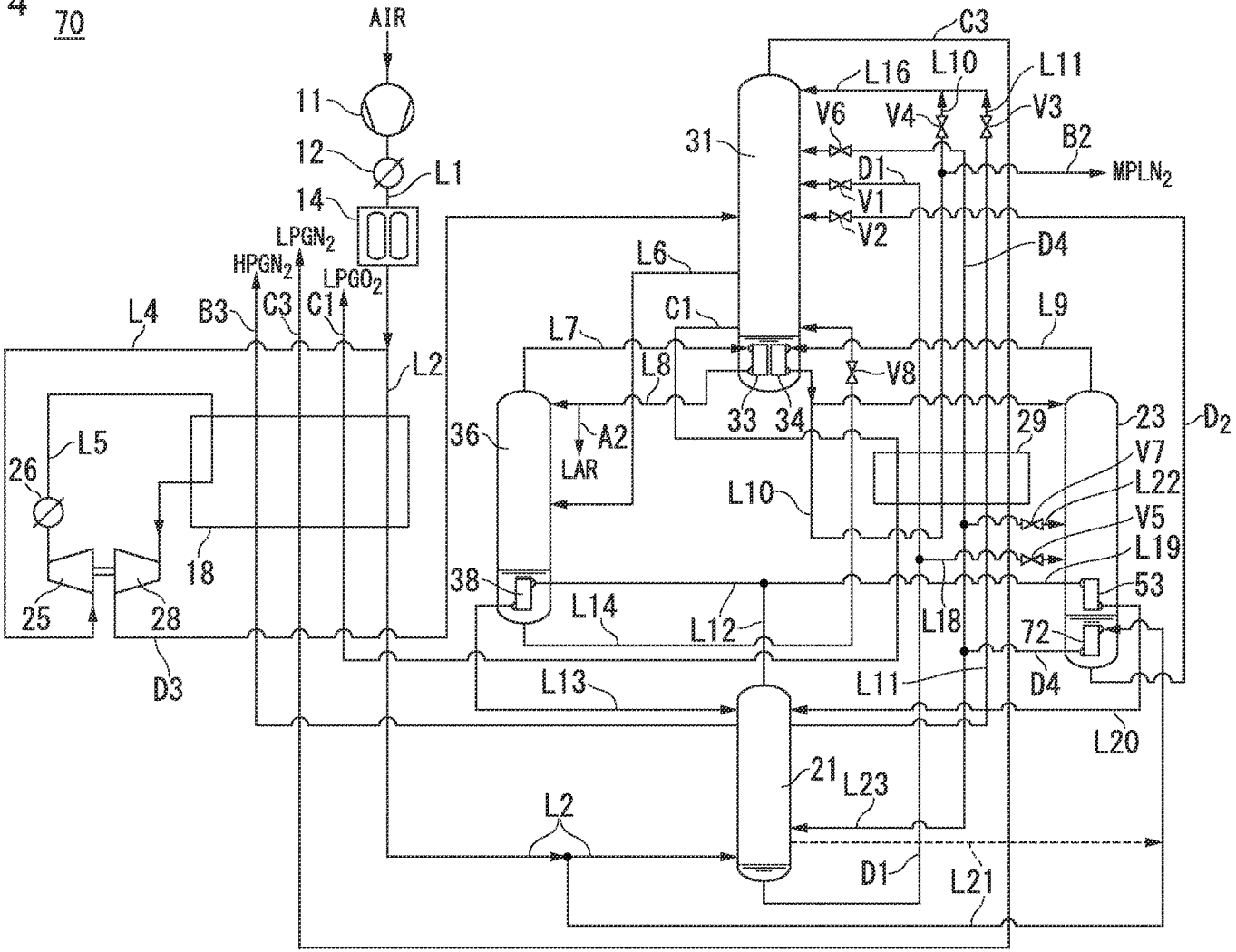
FIG. 4 is a schematic block diagram showing an air separation apparatus of the fourth embodiment according to the present invention.

FIG. 4 is a schematic block diagram showing an air separation apparatus 70 of the fourth embodiment according to the present invention. The same components of the air separation apparatus 70 in FIG. 4 as those in the air separation apparatus 50 shown in FIG. 2 have the same reference number as shown in FIG. 2. Thereby, an explanation for those same components is omitted in this embodiment.

As shown in FIG. 4, the air separation apparatus 70 has the same structure as that of the air separation apparatus 50 of the second embodiment except that the air separation apparatus 70 further includes a third middle-pressure column reboiler 72, a fourth low-pressure feed supply line D4, lines L21 to L23, decompression valves V6 and V7 in addition to the components of the air separation apparatus 50 of the second embodiment.

The third middle-pressure column reboiler 72 is arranged at the bottom part of the middle-pressure column 23, where is lower than the first middle-pressure column reboiler 53. The third middle-pressure column reboiler 72 is connected to the line L21 which is branched from the line L2 which transfer the high-pressure feed air. Thereby, the line L21 supplies a part of the high-pressure feed air to the third middle-pressure column reboiler 72.

Moreover, the line L21 may be connected to the lower part of the high-pressure column 21. In this case, the line L21 supplies high-pressure nitrogen enriched air, which rises in the high-pressure column 21, to the third middle-pressure column reboiler 72.

As explained in the second embodiment, in the first middle-pressure column reboiler 53, the indirect heat exchange (fourth indirect heat exchange step) is carried out between the middle-pressure oxygen enriched liquefied air at the lower part of the middle-pressure column 23 and a part of the high-pressure nitrogen gas withdrawn from the upper part of the high-pressure column 21, a part of the middle-pressure oxygen enriched liquefied air is vaporized, and the middle-pressure oxygen enriched air is produced while the high-pressure nitrogen gas is liquefied, and the high-pressure liquefied nitrogen is produced.

In the third middle-pressure column reboiler 72, by indirect heat exchange between a part of the high-pressure feed air or a part of high-pressure nitrogen enriched air, which rises in the high-pressure column 21, and the middle-pressure oxygen enriched liquefied air, which is not vaporized in the first middle-pressure column reboiler 53, (in other words, middle-pressure oxygen enriched liquefied air which is not vaporized after the fourth indirect heat exchange step), a part of the high-pressure feed air or a part of the high-pressure nitrogen enriched air is liquefied while a part of the middle-pressure oxygen enriched liquefied air is vaporized (sixth indirect heat exchange step).

By the sixth indirect heat exchange step, the middle-pressure oxygen enriched liquefied air is vaporized, and becomes the middle-pressure oxygen enriched air. At the same time, a part of the high-pressure feed air or a part of the high-pressure nitrogen enriched air is liquefied, and becomes the high-pressure liquefied air or the high-pressure nitrogen enriched liquefied air.

The middle-pressure oxygen enriched air produced by the third middle-pressure column reboiler 72 is mixed with the middle-pressure oxygen enriched air produced by the first middle-pressure column reboiler 53, and becomes a rising gas in the middle-pressure column 23. Then, the rising gas is distilled by the gas-liquid contact between the middle-pressure liquefied nitrogen introduced to the top part of the middle-pressure column 23. Thereby, the nitrogen component is concentrated toward the top part of the middle-pressure column 23.

The high-pressure liquefied air or the high-pressure nitrogen enriched liquefied air, which is produced by the third middle-pressure column reboiler 72, is withdrawn to the fourth low-pressure feed supply line D4, decompressed by the decompression valve V6, and supplied into the low-pressure column 31 as the low-pressure feed (low-pressure feed supply step).

The middle-pressure oxygen enriched liquefied air, which is not vaporized by the third middle-pressure column reboiler 72, is withdrawn to the second low-pressure feed supply line D2, decompressed by the decompression valve V2, and supplied into the low-pressure column 31 as the low-pressure feed (low-pressure feed supply step).

In addition, the high-pressure oxygen enriched liquefied air, which is withdrawn to the first low-pressure feed supply line D1, decompressed by the decompression valve V1, and supplied into the low-pressure column 31 as the low-pressure feed (low-pressure feed supply step).

The line L22 is branched from the fourth low-pressure feed supply line D4, and connected to the central part of the middle-pressure column 23 through the decompression valve V7. The line L22 supplies the high-pressure liquefied air or the high-pressure nitrogen enriched liquefied air, which is produced by the third middle-pressure column reboiler 72, into the middle-pressure column 23.

The line L23 is branched from the fourth low-pressure feed supply line D4, and connected to the central part of the high-pressure column 21. The line L22 supplies the high-pressure liquefied air or the high-pressure nitrogen enriched liquefied air, which is produced by the third middle-pressure column reboiler 72, into the high-pressure column 21.

However, the lines L22 and L23, and the decompression valve V7 are not always necessary.

The air separation apparatus of the fourth embodiment includes the third middle-pressure column reboiler 72 in which, by the indirect heat exchange between a part of the high-pressure feed air or a part of high-pressure nitrogen enriched air, which rises in the high-pressure column 21, and the middle-pressure oxygen enriched liquefied air, which is not vaporized in the first middle-pressure column reboiler 53, a part of the high-pressure feed air or a part of the high-pressure nitrogen enriched air is liquefied while a part of the middle-pressure oxygen enriched liquefied air is vaporized, in addition to the components of the air separation apparatus 50 of the second embodiment. Thereby, it is possible to indirectly exchange heat between the middle-pressure oxygen enriched liquefied air, which exists upper than middle-pressure oxygen enriched liquefied air at the bottom part of the middle-pressure column 23, and has a low oxygen concentration and low temperature, and the high-pressure nitrogen gas. At the same time, it is also possible to indirectly exchange heat between the middle-pressure oxygen enriched liquefied air at the bottom part of the middle-pressure column 23 and the high-pressure feed air or the high-pressure nitrogen enriched air, which has a lower nitrogen concentration and has higher temperature than those of the high-pressure nitrogen gas. Thereby, the middle-pressure oxygen enriched liquefied air can be efficiently vaporized at the lower part and the bottom part of the middle-pressure column 23, and the middle-pressure oxygen enriched air can be efficiently produced.

Thereby, it is possible to produce the middle-pressure oxygen enriched liquefied air having a higher oxygen concentration than that of the middle-pressure oxygen enriched liquefied air produced by the air separation apparatus 50 of the second embodiment. At the same time, since the middle-pressure oxygen enriched liquefied air can be supplied into the low-pressure column 31, the rectification conditions at the lower part (a part for concentrating oxygen) of the low-pressure column 31 can be improved.

In addition, in the air separation apparatus 60 of the third embodiment, the high-pressure liquefied air or the high-pressure nitrogen enriched liquefied air is produced by the indirect heat exchange by the second middle-pressure column reboiler 63; however, in the air separation apparatus 70 of the fourth embodiment, the high-pressure liquefied nitrogen can be produced by the indirect heat exchange by the first middle-pressure column reboiler 53, while the high-pressure liquefied nitrogen can be supplied to the top part of the low-pressure column 31. Thereby, the rectification conditions at the upper part (a part for concentrating nitrogen) of the low-pressure column 31 can also be improved.

Due to this, it is possible to improve the argon recovery, liquefied gas products, middle-pressure nitrogen gas or high-pressure nitrogen gas.

The air separation method according to the fourth embodiment using the air separation apparatus 70 is carried out in the same manner as the air separation method according to the second embodiment except that the air separation method according to the fourth embodiment includes the sixth indirect heat exchange step.

The air separation method of the fourth embodiment includes the sixth indirect heat exchange step in addition to the steps of the air separation method of the second embodiment. Thereby, it is possible to indirectly exchange heat between the middle-pressure oxygen enriched liquefied air which exists upper than the middle-pressure oxygen enriched liquefied air at the bottom part of the middle-pressure column 23, and the high-pressure nitrogen gas. In addition, it is also possible to indirectly exchange heat between the middle-pressure oxygen enriched liquefied air at the bottom part of the middle-pressure column 23 and the high-pressure feed air or the high-pressure nitrogen enriched air, which has a lower nitrogen concentration and higher temperature than those of the high-pressure nitrogen gas. Thereby, the middle-pressure oxygen enriched liquefied air can be efficiently vaporized at the lower part and the bottom part of the middle-pressure column 23, and the middle-pressure oxygen enriched air can be efficiently produced.

Thereby, it is possible to produce the middle-pressure oxygen enriched liquefied air having a higher oxygen concentration than that of the middle-pressure oxygen enriched liquefied air produced by the air separation method of the second embodiment. At the same time, since the middle-pressure oxygen enriched liquefied air can be supplied into the low-pressure column 31, the rectification conditions at the lower part (a part for concentrating oxygen) of the low-pressure column 31 can be improved.

In addition, in the air separation method of the third embodiment, the high-pressure liquefied air or the high-pressure nitrogen enriched liquefied air is produced by the fifth indirect heat exchange; however, in the air separation method of the fourth embodiment, the high-pressure liquefied nitrogen can be produced by the fourth indirect heat exchange, while the high-pressure liquefied nitrogen can be supplied to the top part of the low-pressure column 31. Thereby, the rectification conditions at the upper part (a part for concentrating nitrogen) of the low-pressure column 31 can be improved.

Due to this, since the rectification conditions of the whole low-pressure column 31 are improved, it is possible to improve the argon recovery, liquefied gas products, middle-pressure nitrogen gas or high-pressure nitrogen gas.

Moreover, the air separation apparatus 70 of the fourth embodiment can obtain the same effects as those of the air separation apparatus 10, 50 and 60 of the first to third embodiments. In addition, the air separation method of the fourth embodiment can also obtain the same effects as those of the air separation methods of the first to third embodiments.

(Fifth Embodiment)

Figure 5:
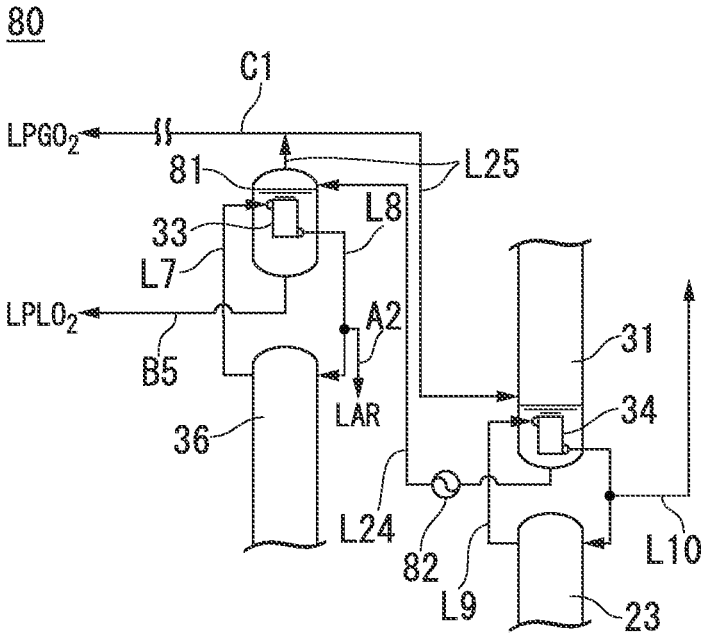
FIG. 5 is a schematic block diagram showing an enlarged main part of the air separation apparatus of the fifth embodiment according to the present invention.

FIG. 5 is a schematic block diagram showing a main part of an air separation apparatus of the fifth embodiment according to the present invention.

FIG. 5 shows only the vicinity of the first and second low-pressure column reboilers 33 and 34 in the air separation apparatus 80 of the fifth embodiment. In addition, the same components of the air separation apparatus in FIG. 5 as those in the air separation apparatus 10 shown in FIG. 1 have the same reference number as shown in FIG. 1.

As shown in FIG. 5, the air separation apparatus 80 of the fifth embodiment has the same structure that of the air separation apparatus 10, 50, 60, and 70 of the first to fourth embodiments, except that the air separation apparatus 80 of the fifth embodiment further includes a low-pressure liquefied oxygen vessel 81, lines L24, and L25, and a liquefied oxygen pump 82, and the first low-pressure column reboiler 33 is arranged in the low-pressure liquefied oxygen vessel 81.

The first low-pressure column reboiler 33 is connected to the lines L7 and L8. One end of the line L24 is connected to the bottom part of the low-pressure column 31, and the other end is connected to the low-pressure liquefied oxygen vessel 81.

The line L25 is connected to the low-pressure liquefied oxygen vessel 81 and the bottom part of the low-pressure column 31. The liquefied oxygen pump 82 is provided to the line L24. One end of the third product withdrawing line C1 is connected to the line L25.

As explained above, in the air separation apparatus 10, 50, 60, and 70 of the first to fourth embodiments, the first low-pressure column reboiler 33 and the second low-pressure column reboiler 34 are arranged in parallel at the bottom part of the low-pressure column 31. However, as the air separation apparatus 80 of the fifth embodiment, the first low-pressure column reboiler 33 and the second low-pressure column reboiler 34 may be arranged in series.

In the air separation apparatus 80, only the second low-pressure reboiler 34 is arranged at the bottom part of the low-pressure column 31. The first low-pressure column reboiler 33 is arranged in the low-pressure liquefied oxygen vessel 81, other than the low-pressure column 31.

The low-pressure liquefied oxygen, which is not vaporized in the second low-pressure column reboiler 34, is withdrawn to the line L24, compressed by the liquefied oxygen pump 82, and then introduced into the low-pressure liquefied oxygen vessel 81.

In the first low-pressure column reboiler 33 arranged in the low-pressure liquefied oxygen vessel 81, the indirect heat exchange is carried out between a part or the whole of the low-pressure liquefied oxygen introduced into the low-pressure liquefied oxygen vessel 81 and the argon gas supplied from the argon column 36 (first indirect heat exchange step).

Thereby, a part or the whole of the low-pressure liquefied oxygen is vaporized, and the low-pressure oxygen gas is produced while the argon gas is liquefied, and the liquefied argon is produced.

The low-pressure oxygen gas produced by the first low-pressure column reboiler 33 is withdrawn from the low-pressure liquefied oxygen vessel 81 to the line L25. A part or the whole of the low-pressure oxygen gas is supplied to the bottom part of the low-pressure column 31.

When the low-pressure oxygen gas ($LPGO_2$) which is one of the products is collected, a part or the whole of the low-pressure oxygen gas in the line L25 is withdrawn to the third product withdrawing line C1. After heat recovery in the subcooler 29 and the main heat exchanger 18, the low-pressure oxygen gas is withdrawn as a product.

In the air separation apparatus 80 explained above, the liquefied oxygen tank 81, and the lines L24 and L25 can be considered as a part of the low-pressure column 31. The air separation apparatus 80 of the fifth embodiment can obtain the same effects as those of the air separation apparatus 10, 50, 60, and 70 of the first to fourth embodiments.

In addition, the air separation method of the fifth embodiment using the air separation apparatus 80 can also obtain the same effects as those of the air separation method of the first to fourth embodiments.

Hereinabove, the preferred embodiments of the present invention have been described. However, it is needless to say that the present invention is not limited to the embodiments. Various deformations or modifications can be made within a range not departing from the scope of the present invention.

For example, a method, in which when the high-pressure oxygen gas ($HPGO_2$) is collected, the liquefied oxygen is withdrawn from the bottom part of the low-pressure column, compressed to desired pressure by a liquefied gas pump, the compressed liquefied oxygen is introduced into a main heat exchanger, the whole compressed liquefied oxygen is vaporized, warmed to a normal temperature by heat recovery, and the produced high-pressure oxygen gas ($HPGO_2$) is collected, has been disclosed as a well-known method (for example, U.S. Pat. No. 4,939,651). Such a method can be used in the air separation method of the first to fifth embodiments.

In other words, when the high-pressure oxygen gas ($HPGO_2$), which has higher pressure than the operating pressure of the argon column 36, is collected as a product, the low-pressure liquefied oxygen at the bottom part of the low-pressure column 31 and/or the middle-pressure liquefied oxygen at the bottom part of the argon column 36 is withdrawn each distillation column, and compressed to desired pressure by a liquefied gas pump (not shown in the figures).

The high-pressure liquefied oxygen, which is compressed by the liquefied gas pump (not shown in the figures), is introduced into the main heat exchanger 18, vaporized in the main heat exchanger 18, warmed to a normal temperature by heat recovery, and collected as the high-pressure oxygen gas ($HPGO_2$) which is one of the products.

At this time, a part of the air, which is refined by the air purifier 14, may be introduced into an air compressor (not shown in the figures) to be further compressed, super high-pressure feed air may be produced, and then introduced into the main heat exchanger 18.

By the indirect heat exchange with the high-pressure liquefied oxygen compressed by a liquefied gas pump (not shown in the figures), the whole of the super high-pressure feed air introduced into the main heat exchanger 18 makes the high-pressure liquefied oxygen vaporize and produce the high-pressure oxygen gas, while the whole of the super high-pressure feed air itself is condensed, and becomes the super high-pressure liquefied air.

The super high-pressure liquefied air withdrawn from the main heat exchanger 18 is decompressed by a liquefied gas turbine (not shown in the figures) or a decompression valve (not shown in the figures), and then introduced into at least one of the high-pressure column 21, the middle-pressure column 23, and the low-pressure column 31.

Moreover, the high-pressure oxygen gas, which is the product, and the super high-pressure feed air is gas fluid or supercritical fluid.

In addition, for example, when it is necessary to produce oxygen gas, and argon gas or liquefied argon, and not necessary to produce the middle-pressure nitrogen gas, the high-pressure nitrogen gas, the liquefied oxygen, and the liquefied nitrogen in the air separation apparatus 10, 50, 60, 70, and 80 of the first to fifth embodiments, it is possible to decrease the whole of the electric power consumption in the apparatus by introducing the high-pressure nitrogen gas $HPGN_2$ or the middle-pressure nitrogen gas $MPGN_2$, which is one of the products and collected in the apparatus, into a power recovery turbine (not shown in the figures), adiabatically expanding to generate power.

By the way, in the air separation apparatus 10, 50, 60, 70, and 80 of the first to fifth embodiments, the high-pressure column 21, the middle-pressure column 23, the low-pressure column 31, and the argon column 36 are thermally united through each reboiler. Therefore, the operating pressure is increased in this order of the low-pressure column 31, the argon column 36, the middle-pressure column 23, and the high-pressure column 21.

For example, the low-temperature distillation systems for separating air disclosed in Japanese Patent No. 540,182 is a process in which the high-pressure column, the middle-pressure column, the low-pressure column, and the argon column are thermally united. In the process, the bottom part of the argon column is thermally united with the top part of the low-pressure column, and the operating pressure of the low-pressure column is higher than that of the argon column. Therefore, the low-temperature distillation systems for separating air disclosed in Japanese Patent No. 540,182 is different from the air separation apparatus 10, 50, 60, 70, and 80 of the first to fifth embodiments.

EXAMPLE 1

The results obtained by the air separation apparatus 50 of the second embodiment shown in FIG. 2 were simulated using a simulator produced by oneself (the simulator is the same as that is used to design an air separation apparatus in practice).

The calculation conditions of the simulation are: from the feed air having a flow rate of 2412, the low-pressure oxygen gas ($LPGO_2$) having a flow rate of 500, pressure of 120 kPaA, and an oxygen concentration of 99.6% or more, and the liquefied argon (LAR) having a flow rate of 18, oxygen concentration of 1 ppm or less, nitrogen concentration of 1 ppm were collected while collecting the high-pressure nitrogen gas ($HPGN_2$) having pressure of 820 kPaA or more, and an oxygen concentration of 0.1 ppm or less or the middle-pressure nitrogen gas ($MPGN_2$, not shown in the FIG. 2) having pressure of 480 kPaA or more, and an oxygen concentration of 0.1 ppm or less as much as possible. The flow rate, the pressure, and the oxygen concentration of the fluid at each of measuring point are shown in Table 1.

TABLE 1

| Measuring point | Flow Rate of Fluid | Pressure in Line | Oxygen concentration of Fluid |
|---|---|---|---|
| Line Ll | 2412 | 863 | 21.0% |
| Vicinity of the outlet of the second product withdrawing line B3 | 716 | 820 | 0.1 ppm |
| Second low-pressure feed supply line D2 | 735 | 516 | 49.2% |
| Line L5 at the inlet of the turbine | 144 | 1749 | 21.0% |
| Third low-pressure feed supply line D3 | 144 | 133 | 21.0% |
| Vicinity of the outlet of the third product withdrawing line C3 | 1177 | 116 | 0.6% |
| Vicinity of the outlet of the third product withdrawing line Cl | 500 | 120 | 99.7% |
| Line L6 | 283 | 133 | 93.3% |
| First product withdrawing line A2 | 18 | 197 | 1.0 ppm |
| Line L18 | 1001 | 813 | 36.1% |

As shown in Table 1, it is confirmed that the low-pressure oxygen gas (product) having a flow rate of 500, pressure of 120 kPaA, and an oxygen concentration of 99.7%, the liquefied argon (product) having a flow rate of 18, and an oxygen concentration of 1 ppm (nitrogen concentration of 1 ppm or less), and the high-pressure nitrogen gas (product) having a flow rate of 716, pressure of 820 kPaA, and an oxygen concentration of 0.1 ppm or less were collected from the feed air having a flow rate of 2412 using the air separation apparatus 50 of the second embodiment.

In the simulation, the middle-pressure nitrogen gas having pressure of 480 kPaA or more, and oxygen concentration of 0.1 ppm or less was not collected.

COMPARATIVE EXAMPLE 1

Figure 6:
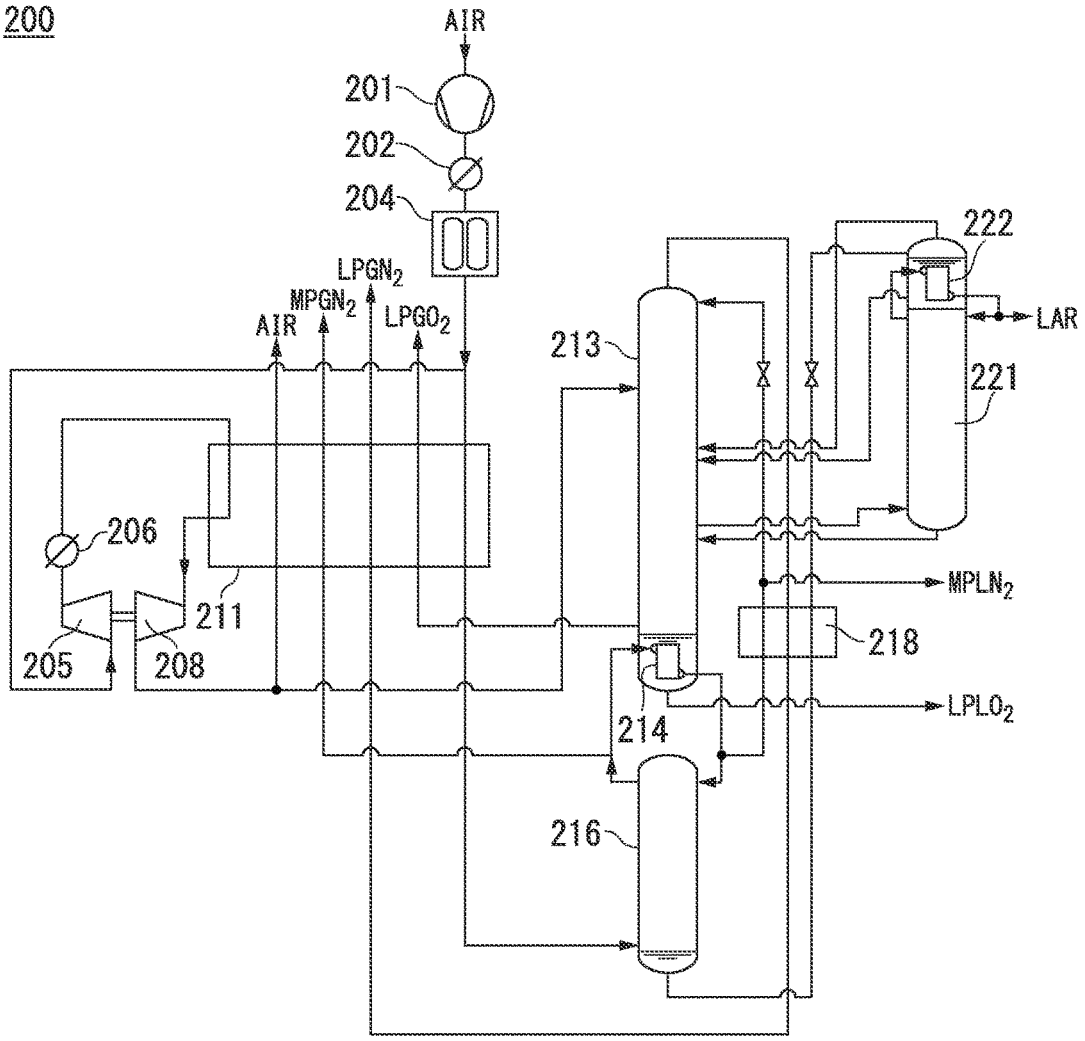
FIG. 6 is a schematic block diagram showing a conventional air separation apparatus.

In order to evaluate the effectiveness of Example 1, the results obtained by the air separation apparatus 200 shown in FIG. 6 were simulated.

The calculation conditions of the simulation are the same as those of Example 1: from the feed air having a flow rate of 2412, the low-pressure oxygen gas ($LPGO_2$) having a flow rate of 500, pressure of 120 kPaA, and an oxygen concentration of 99.6% or more, and the liquefied argon (LAR) having a flow rate of 18, an oxygen concentration of 1 ppm or less, and a nitrogen concentration of 1 ppm or less were collected while collecting the high-pressure nitrogen gas ($HPGN_2$) having pressure of 820 kPaA or more, oxygen concentration of 0.1 ppm or less or the middle-pressure nitrogen gas ($MPGN_2$) having pressure of 480 kPaA or more, and an oxygen concentration of 0.1 ppm or less as much as possible.

In Comparative Example 1, the same simulator used in Example 1 was used, and the other calculation conditions (such as the pressure loss at each part, the temperature difference in reboilers) were also the same as those of Example 1. The simulation results of Example 1 and Comparative Example 1 are shown in Table 2.

TABLE 2

| | | Comparative Example | Example |
|---|---|---|---|
| Feed air | Flow rate | 2412 | 2412 |
| | Pressure (kPaA) | 529 | 863 |
| Low-pressure oxygen gas (Product) | Flow rate | 500 | 500 |
| | Pressure (kPaA) | 120 | 120 |
| Liquefied argon (Product) | Flow rate | 18 | 18 |

TABLE 2-continued

| | | Comparative Example | Example |
|---|---|---|---|
| High-pressure nitrogen gas (Product) | Flow rate | 0 | 716 |
| | Pressure (kPaA) | 820 | 820 |
| Middle-pressure nitrogen gas (product) | Flow rate | 0 | 0 |
| | Pressure (kPaA) | 480 | 480 |

As shown in Table 2, both of the apparatus (the air separation apparatus 50 and the air separation apparatus 200) could collect the low-pressure oxygen gas ($LPGO_2$) having a flow rate of 500, pressure of 120 kPaA, and an oxygen concentration of 99.6% or more, and the liquefied argon (LAR) having a flow rate of 18, an oxygen concentration of 1 ppm or less, and a nitrogen concentration of 1 ppm or less as a product, and the argon recovery are the same in both apparatus.

However, Example 1 could collect the high-pressure nitrogen gas ($HPGN_2$) having a flow rate of 716, but Comparative Example 1 could not collect the high-pressure nitrogen gas ($HPGN_2$) and the middle-pressure nitrogen gas ($MPGN_2$).

The electric power consumption of each unit in Example 1 and Comparative Example 1 which is obtained by simulation calculation are shown in Table 3. Since the high-pressure nitrogen gas ($HPGN_2$) could not be collected in Comparative Example 1, the low-pressure nitrogen gas ($LPGN_2$) having a flow rate of 716, which is a part of the low-pressure nitrogen gas ($LPGN_2$) obtained as a byproduct, was compressed to 820 kPaA by a nitrogen compressor (not shown in the figures), and thereby the high-pressure nitrogen gas was produced.

TABLE 3

| | Comparative Example 1 | Example 1 |
|---|---|---|
| Electric power consumption of air compressor | 100 | 130 |
| Electric power consumption of nitrogen compressor | 39 | 0 |
| Total of the electric power consumption of air compressor and nitrogen compressor | 139 | 130 |

As shown in Table 3, it is confirmed that the pressure of the feed air is higher and the electric power consumption of the air compressor 11 is larger by 30% in Example 1, compared with Comparative Example 1. However, since the nitrogen compressor is not necessary in Example 1, it is confirmed that the total electric power consumption is decreased by about 6%.

EXAMPLE 2

The results obtained by the air separation apparatus 70 of the fourth embodiment were simulated using the same simulator as that used in Example 1.

The calculation conditions of the simulation are: from the feed air having a flow rate of 2412, the low-pressure oxygen gas ($LPGO_2$) having a flow rate of 500, pressure of 120 kPaA, and an oxygen concentration of 99.6% or more, and the liquefied argon (LAR) having a flow rate of 18, an oxygen concentration of 1 ppm or less, and a nitrogen concentration of 1 ppm were collected while collecting the middle-pressure liquefied nitrogen ($MPLN_2$) having an oxygen concentration of 0.1 ppm or less as much as possible. The results are shown in Table 4.

TABLE 4

| | | Comparative Example 2 | Example 2 |
|---|---|---|---|
| Feed air | Flow rate | 2412 | 2412 |
| | Pressure (kPaA) | 529 | 853 |
| Low-pressure oxygen gas (Product) | Flow rate | 500 | 500 |
| | Pressure (kPaA) | 120 | 120 |
| Liquefied argon (Product) | Flow rate | 18 | 18 |
| Middle-pressure nitrogen gas (product) | Flow rate | 0 | 92 |

COMPARATIVE EXAMPLE 2

In order to evaluate the effectiveness of Example 2, the results obtained by the air separation apparatus 200 shown in FIG. 6 were simulated using the same calculation conditions and the same simulator as those of Example 2. The simulation results are shown in Table 4.

(Summary of the Results of Comparative Example 2 and Example 2)

As shown in Table 4, the argon recovery is the same in both apparatus (the air separation apparatus 70 and the air separation apparatus 200). However, Comparative Example 2 could not collect the middle-pressure liquefied nitrogen (product), in contrast, Example 2 could collect the middle-pressure liquefied nitrogen having a flow rate of 92.

In Comparative Example 2, in order to increase the flow rate of the liquefied gas product, it is necessary to increase the throughput of the turbine 208, but due to this, the amount of the low-pressure turbine air becomes too large, a large amount of the low-pressure turbine air cannot be separated in the low-pressure column 213, the argon recovery decreases, and thereby the middle-pressure liquefied nitrogen (product) cannot be collected.

INDUSTRIAL APPLICABILITY

According to the present invention, it is possible to provide the air separation method and the air separation apparatus which can collect a larger amount of the middle-pressure nitrogen gas, the high-pressure nitrogen gas having high pressure than that of the middle-pressure nitrogen gas, the liquefied oxygen, and liquefied nitrogen, and so on while inhibiting a decrease of the argon recovery.

DESCRIPTION OF THE REFERENCE NUMERALS

10, 50, 60, 70, and 80 . . . air separation apparatus
11 . . . air compressor
12 . . . air precooler
14 . . . air purifier
15 . . . air blower
16 . . . air blower aftercooler
18 . . . main heat exchanger
21 . . . high-pressure column
23 . . . middle-pressure column
25 . . . turbine blower
26 . . . turbine blower aftercooler
28 . . . turbine
29 . . . subcooler
31 . . . low-pressure column
33 . . . first low-pressure column reboiler
34 . . . second low-pressure column reboiler
36 . . . argon column
38 . . . argon column reboiler
53 . . . first middle-pressure column reboiler
63 . . . second middle-pressure column reboiler
72 . . . third middle-pressure column reboiler
81 . . . low-pressure liquefied oxygen vessel
82 . . . liquefied oxygen pump
A1 and A2 . . . first product withdrawing line
B1, B2, B3, B4, B5, B6 . . . second product withdrawing line
C1, C2, and C3 . . . third product withdrawing line
D1 . . . first low-pressure feed supply line
D2 . . . second low-pressure feed supply line
D3 . . . third low-pressure feed supply line
D4 . . . fourth low-pressure feed supply line,
L1 to L25 . . . line
V1 to V8 . . . decompression valve

The invention claimed is:

1. An air separation apparatus comprising:

a low-pressure column in which a mixed fluid containing oxygen, nitrogen, and argon, which is a low-pressure feed, is distilled at temperatures, between a nitrogen saturation temperature and an oxygen saturation temperature at an operating pressure of the low-pressure column, and separated into a low-pressure nitrogen gas, a low-pressure liquefied oxygen, and a liquefied feed argon;

an argon column in which the liquefied feed argon is distilled at temperatures between an argon saturation temperature and an oxygen saturation temperature at an operating pressure of the argon column, and separated into an argon gas and a middle-pressure liquefied oxygen;

a first low-pressure column reboiler in which, by indirect heat exchange between the argon gas and the low-pressure liquefied oxygen, the argon gas is liquefied to form a liquefied argon while a part of the low-pressure liquefied oxygen is vaporized to form a low-pressure oxygen gas;

a second low-pressure column reboiler in which, by indirect heat exchange between a middle-pressure nitrogen gas supplied from a middle-pressure column and the low-pressure liquefied oxygen, the middle-pressure nitrogen gas is liquefied to form a middle-pressure liquefied nitrogen while a part of the low-pressure liquefied oxygen is vaporized to form another low-pressure oxygen gas;

an argon column reboiler in which, by indirect heat exchange between a high-pressure nitrogen gas supplied from a high-pressure column and the middle-pressure liquefied oxygen, the high-pressure nitrogen gas is liquefied to form a high-pressure liquefied nitrogen while a part of the middle-pressure liquefied oxygen is vaporized to form a middle-pressure oxygen gas;

a first product extracting line in which at least one among a part of the argon gas an argon gas which is not liquefied in the first low-pressure column reboiler, and a part of the liquefied argon is extracted; and a second product extracting line in which at least one among a low-pressure liquefied oxygen which is not vaporized in the first and second low-pressure column reboilers, a middle-pressure liquefied oxygen which is not vaporized in the argon column reboiler, a part of the middle-pressure nitrogen gas at a top part of the middle-pressure column, a part of the middle-pressure liquefied nitrogen which is condensed by the second low-pressure column reboiler, a part of the high-pressure nitrogen gas at a top part of the high-pressure column, and a part of the high-pressure liquefied nitrogen at the top part of the high-pressure column is extracted, wherein the operating pressure of the argon column is higher than the operating pressure of the low-pressure column.

2. The air separation apparatus according to claim 1, wherein in the high-pressure column a part or a whole of a high-pressure feed air, which is obtained by compressing, refining, and cooling air, is distilled at temperatures between a nitrogen saturation temperature and an oxygen saturation temperature at an operating pressure of the high-pressure column, and separated into the high-pressure nitrogen gas and a high-pressure oxygen enriched liquefied air;

in the middle-pressure column in which a part or a whole of middle-pressure feed air which is obtained by compressing, refining, and cooling air, is distilled at temperatures between a nitrogen saturation temperature and an oxygen saturation temperature at an operating pressure of the middle-pressure column, and separated into the middle-pressure nitrogen gas and a middle-pressure oxygen enriched liquefied air; and the air separation apparatus further comprises a low-pressure feed supply line in which the low-pressure feed is supplied to the low pressure column, and wherein the low-pressure feed is at least one of the high-pressure oxygen enriched liquefied air after decompression and the middle-pressure oxygen enriched liquefied air after decompression.

* * * * *